US010571176B2

(12) United States Patent
Han et al.

(10) Patent No.: US 10,571,176 B2
(45) Date of Patent: Feb. 25, 2020

(54) AIR CONDITIONER AND METHOD FOR CONTROLLING THE SAME

(71) Applicant: Samsung Electronics Co., Ltd., Gyeonggi-do (KR)

(72) Inventors: Kwang-Sik Han, Gyeonggi-do (KR); Jeong Uk Park, Gyeonggi-do (KR); Jong Woon Kim, Gyeonggi-do (KR); Tae Woo Kim, Gyeonggi-do (KR); Hyun Jin Bae, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 259 days.

(21) Appl. No.: 15/054,044

(22) Filed: Feb. 25, 2016

(65) Prior Publication Data

US 2016/0245570 A1 Aug. 25, 2016

(30) Foreign Application Priority Data

Feb. 25, 2015 (KR) ..... 10-2015-0026863

(51) Int. Cl.
*F25B 49/02* (2006.01)

(52) U.S. Cl.
CPC ..... *F25B 49/022* (2013.01); *F25B 49/02* (2013.01); *F25B 2700/2103* (2013.01)

(58) Field of Classification Search
CPC ..... F25B 49/022; F25B 2700/21175; F25B 2700/21174; F25B 2600/21; F25B 2313/0314
See application file for complete search history.

(56) References Cited

U.S. PATENT DOCUMENTS 4,106,306 A * 8/1978 Saunders ..... F25B 45/00 62/149
4,829,777 A * 5/1989 Matsuoka ..... F25B 49/005 62/149

(Continued)

FOREIGN PATENT DOCUMENTS

EP 2088391 A2 8/2009
EP 2270405 A1 1/2011

(Continued)

OTHER PUBLICATIONS

Extended European Search Report dated Jul. 4, 2016 in connection with European Application No. 16156949.6, 6 pages.

(Continued)

*Primary Examiner* — Nelson J Nieves

(57) ABSTRACT

Disclosed herein are an air conditioner and a method for controlling the same. The air conditioner includes an indoor temperature measuring unit that measures an indoor air temperature, an outdoor temperature measuring unit that measures an outdoor air temperature, a heat exchanger temperature measuring unit that measures an inlet temperature of one or more indoor heat exchangers and an outlet temperature thereof, and a processor that determines a reference superheat degree using the indoor air temperature and the outdoor air temperature, obtains a difference between the inlet temperature and the outlet temperature of the one or more indoor heat exchangers, compares the difference between the inlet temperature and the outlet temperature of the one or more indoor heat exchangers and the reference superheat degree, and determines whether a circulation amount of a refrigerant is normal according to a result of the comparison.

11 Claims, 24 Drawing Sheets

(56) References Cited

U.S. PATENT DOCUMENTS 4,873,649 A * 10/1989 Grald ..... F24F 11/0009 62/176.6
5,275,012 A * 1/1994 Dage ..... B60H 1/00392 219/202
9,303,907 B2 * 4/2016 Kawano ..... F25B 45/00
9,759,465 B2 * 9/2017 Schuster ..... F25B 45/00
2003/0182950 A1 * 10/2003 Mei ..... F25B 49/005 62/129
2003/0213256 A1 * 11/2003 Ueda ..... F25B 1/02 62/230
2006/0090484 A1 * 5/2006 Bell ..... F24F 11/0086 62/129
2006/0218946 A1 * 10/2006 Davern ..... F25D 21/008 62/155
2009/0228153 A1 9/2009 Ogawa
2010/0180630 A1 * 7/2010 Ogawa ..... F25B 41/04 62/498
2011/0219790 A1 * 9/2011 Denton ..... F25B 45/00 62/77
2012/0245878 A1 * 9/2012 Kane ..... G05B 15/02 702/116
2013/0245965 A1 * 9/2013 Kane ..... G01D 7/00 702/33
2015/0121718 A1 * 5/2015 Huang ..... D06F 58/28 34/476
2015/0184880 A1 * 7/2015 Kawamura ..... F24F 11/00 700/276
2015/0298525 A1 * 10/2015 Miyakoshi ..... F25B 49/005 62/160

FOREIGN PATENT DOCUMENTS

JP 05196278 A * 8/1993
JP 2001147037 A * 5/2001
JP 2013108651 A * 6/2013
KR 10-2014-0018782 A 2/2014

OTHER PUBLICATIONS

European Patent Office, "Communication pursuant to Article 94(3) EPC," Application No. EP16156949.6, dated Jun. 14, 2019, 5 pages.

* cited by examiner

AIR CONDITIONER AND METHOD FOR CONTROLLING THE SAME

CROSS-REFERENCE TO RELATED APPLICATION AND CLAIM OF PRIORITY

The present application is related to and claims benefit of Korean Patent Application No. 10-2015-0026863, filed on Feb. 25, 2015 in the Korean Intellectual Property Office, the disclosure of which is incorporated herein by reference.

TECHNICAL FIELD

Embodiments of the present invention relate to an air conditioner and a method for controlling the same.

BACKGROUND

An air conditioner is a device that appropriately adjusts air in a room according to the purpose of use, and adjusts the temperature, humidity, air clearness, air flow, and the like of the air in the room. The air conditioner may be used in a variety of places such as general houses, offices, factories, vehicles, etc., and have a variety of types or structures depending on the places where the air conditioner is provided.

Generally, the air conditioner may discharge cooled air obtained through a cooling cycle including processes of compression, condensation, expansion, and evaporation of a refrigerant into a room, and thereby adjust the air in the room.

For this, the air conditioner may include a compressor, a condenser, an expansion valve, an evaporator, and a cooling fan. Specifically, the compressor of the air conditioner compresses a refrigerant in a gaseous state, for example, a Freon gas, and the condenser may condense the compressed refrigerant. The condensed refrigerant is expanded in the expansion valve and changed into a state in which the refrigerant is easy to be evaporated. The expanded refrigerant is evaporated in the evaporator, but in this case, since the refrigerant absorbs ambient heat while it is evaporated, air around the evaporator is cooled. The cooling fan adjusts an indoor air temperature by discharging the cooled air in the room. The refrigerant evaporated in the evaporator is introduced into the compressor again, and the above-described refrigerant cycle is repeatedly performed.

SUMMARY

To address the above-discussed deficiencies, it is a primary object to provide an air conditioner in which a user, a manufacturer, or an installer of the air conditioner may easily and simply determine whether the air conditioner is normally operated, and a method for controlling the same.

It is another aspect of the present invention to provide an air conditioner in which a user, a manufacturer, or an installer of the air conditioner may simply and accurately determine at least one of whether an internal pipe is appropriately connected to the air conditioner during a trial operation of the air conditioner, whether a refrigerant flows inside the air conditioner, and whether an amount of the refrigerant flowing inside the air conditioner is a proper amount, and a method for controlling the same.

Additional aspects of the invention will be set forth in part in the description which follows and, in part, will be obvious from the description, or may be learned by a practice of the invention.

In accordance with one aspect of the present invention, an air conditioner includes an indoor temperature measuring unit configured to measure an indoor air temperature; an outdoor temperature measuring unit configured to measure an outdoor air temperature; a heat exchanger temperature measuring unit configured to measure an inlet temperature of one or more indoor heat exchangers and an outlet temperature thereof; and a processor configured to determine a reference superheat degree using the indoor air temperature and the outdoor air temperature, obtain a difference between the inlet temperature and the outlet temperature of the one or more indoor heat exchangers, compare the difference between the inlet temperature and the outlet temperature of the one or more indoor heat exchangers and the reference superheat degree, and determine whether a circulation amount of a refrigerant is normal according to a result of the comparison.

Here, the processor may determine the reference superheat degree based on a correlation obtained in advance among the indoor air temperature, the outdoor air temperature, and a measured superheat degree.

Also, the processor may determine the reference superheat degree using a linear relational expression among the indoor air temperature, the outdoor air temperature, and the measured superheat degree that are obtained in advance using regression analysis.

Also, the processor determines the reference superheat degree based on Equation 1:

$$Z_1=C_0+C_1\cdot T_r+C_2\cdot T_o \quad \text{[Equation 1]}$$

wherein $Z_1$ denotes the reference superheat degree, $T_r$ denotes the indoor air temperature, $T_o$ denotes the outdoor heat temperature, and $C_0$, $C_1$, and $C_2$ are constants.

Also, the air conditioner may further include a humidity measuring unit that detects indoor humidity, wherein the processor determines the reference superheat degree using the indoor humidity.

Also, the processor may determine the reference superheat degree based on a correlation obtained in advance among the indoor air temperature, the outdoor air temperature, the indoor humidity, and a measured superheat degree.

Also, the processor may determine the reference superheat degree based on Equation 2:

$$Z_2=C_0+C_1\cdot T_r+C_2\cdot T_o+C_3\cdot H_r \quad \text{[Equation 2]}$$

wherein $Z_2$ denotes the reference superheat degree, $T_r$ denotes the indoor air temperature, $T_o$ denotes the outdoor air temperature, $H_r$ denotes the indoor humidity, and $C_0$, $C_1$, $C_2$, and $C_3$ are constants.

Also, the processor may determine that the circulation amount of the refrigerant of the air conditioner is normal when the difference between the inlet temperature and the outlet temperature of the one or more indoor heat exchangers is smaller than or equal to the reference superheat degree, and determine that the circulation amount of the refrigerant of the air conditioner is abnormal when the difference between the inlet temperature and the outlet temperature of the one or more indoor heat exchangers is larger than the reference superheat degree.

Also, the air conditioner may further include a cooling fan that blows cold air generated in the indoor heat exchanger, wherein the processor operates the cooling fan first before the indoor heat exchanger starts to be operated.

Also, the air conditioner may further include a compressor that is connected to the indoor heat exchanger, wherein the processor operates the compressor and determines whether the refrigerant of the air conditioner is normally circulated.

Also, the processor may obtain a difference between a temperature of the indoor heat exchanger and the indoor air temperature, compare the difference between the temperature of the indoor heat exchanger and the indoor air temperature and a first reference value, compare the temperature of the indoor heat exchanger and a second reference value, and determine whether the refrigerant of the air conditioner is normally circulated.

Also, the processor may determine that the refrigerant is normally circulated when the difference between the temperature of the indoor heat exchanger and the indoor air temperature is larger than the first reference value or when the temperature of the indoor heat exchanger is smaller than the second reference value.

Also, the air conditioner may further include a display unit that displays whether the refrigerant of the air conditioner is normally circulated.

Also, the display unit may further display whether the circulation amount of the refrigerant of the air conditioner is normal.

Also, the processor may be provided in an outdoor unit in which a compressor and an outdoor heat exchanger are installed.

Also, the processor may determine whether a plurality of indoor heat exchangers are provided.

Also, the air conditioner may further include a compressor that is connected to the indoor heat exchanger, wherein the processor operates a cooling fan corresponding to each of the plurality of indoor heat exchangers before the plurality of indoor heat exchangers.

Also, the processor may determine at least one of whether a refrigerant of a first indoor heat exchanger of the plurality of indoor heat exchangers is normally circulated and whether the circulation amount of the refrigerant is normal, and maintain an operation of the cooling fan corresponding to a second indoor heat exchanger of the plurality of indoor heat exchangers.

Also, the processor may determine whether a refrigerant of the second indoor heat exchanger is normally circulated, when the determining of the at least one of whether the refrigerant of the first indoor heat exchanger is normally circulated and whether the circulation amount of the refrigerant is normal is terminated.

Also, the air conditioner may further include a display unit that displays information about an indoor unit in which the refrigerant is abnormally circulated or in which the circulation amount of the refrigerant is abnormal among the plurality of indoor heat exchangers.

In accordance with another aspect of the present invention, a method for controlling an air conditioner in which an indoor heat exchanger is provided and which includes an indoor unit installed in a room, includes obtaining a difference between an inlet temperature of the indoor heat exchanger and an outlet temperature thereof; obtaining an indoor air temperature and an outdoor air temperature; comparing a reference superheat degree determined using the indoor air temperature and the outdoor air temperature and the difference between the inlet temperature and the outlet temperature of the indoor heat exchanger; and determining whether a circulation amount of a refrigerant of the air conditioner is normal based on a result of the comparison.

Here, the reference superheat degree may be determined based on correlation among the indoor air temperature, the outdoor air temperature, and a measurement superheat degree.

Also, the reference superheat degree may be determined using a linear relational expression among the indoor air temperature, the outdoor air temperature, and the measured superheat degree which are obtained in advance using regression analysis.

Also, the reference superheat degree may be determined based on Equation 1:

$$Z_1=C_0+C_1\cdot T_r+C_2\cdot T_o \quad \text{[Equation 1]}$$

wherein $Z_1$ denotes the reference superheat degree, $T_r$ denotes the indoor air temperature, $T_o$ denotes the outdoor heat temperature, and $C_0$, $C_1$, and $C_2$ are constants.

Also, the reference superheat degree may be determined further using indoor humidity.

Also, the reference superheat degree may be determined based on a correlation among the indoor air temperature, the outdoor air temperature, the indoor humidity, and a measured superheat degree.

Also, the reference superheat degree is determined based on Equation 2:

$$Z_2=C_0+C_1\cdot T_r+C_2\cdot T_o+C_3\cdot H_r \quad \text{[Equation 2]}$$

wherein $Z_2$ denotes the reference superheat degree, $T_r$ denotes the indoor air temperature, $T_o$ denotes the outdoor air temperature, $H_r$ denotes the indoor humidity, and $C_0$, $C_1$, $C_2$, and $C_3$ are constants.

Also, the determining of whether the circulation amount of the refrigerant of the air conditioner is normal based on the comparison result may include determining that the circulation amount of the refrigerant of the air conditioner is normal when the difference between the inlet temperature and the outlet temperature of the indoor heat exchanger is smaller than or equal to the reference superheat degree, and determining that the circulation amount of the refrigerant of the air conditioner is abnormal when the difference between the inlet temperature and the outlet temperature of the indoor heat exchanger is larger than the reference superheat degree.

Also, the indoor unit may further include a cooling fan that blows cold air generated in the indoor heat exchanger, and the method may further include: operating the cooling fan before the indoor heat exchanger is operated.

Also, the air conditioner may further include an outdoor unit in which a compressor connected to the indoor heat exchanger is provided, and the method may further include operating the compressor after the operation of the cooling fan is terminated, and determining whether the refrigerant of the air conditioner is normally circulated.

Also, the determining of whether the refrigerant of the air conditioner is normally circulated may include obtaining a difference between a temperature of the indoor heat exchanger and the indoor air temperature, comparing the difference between the temperature of the indoor heat exchanger and the indoor air temperature and a first reference value, and comparing the temperature of the indoor heat exchanger and a second reference value.

Also, the determining of whether the refrigerant is normally circulated may further include determining that the refrigerant is normally circulated when the difference between the temperature of the indoor heat exchanger and the indoor air temperature is larger than the first reference value or when the temperature of the indoor heat exchanger is smaller than the second reference value.

Also, the method may further include displaying whether the refrigerant of the air conditioner is normally circulated.

Also, the method may further include displaying whether the circulation amount of the refrigerant of the air conditioner is normal.

Also, the air conditioner may further include an outdoor unit in which a compressor and an outdoor heat exchanger are provided, and the outdoor unit may perform an operation of comparing the reference superheat degree determined using the indoor air temperature and the outdoor air temperature and the difference between the inlet temperature and the outlet temperature of the indoor heat exchanger and an operation of determining whether the circulation amount of the refrigerant of the air conditioner is normal based on the comparison result, and transmit a result of the determination to the indoor unit.

In accordance with still another aspect of the present invention, a method for controlling an air conditioner including a plurality of indoor units includes: determining whether the plurality of indoor units are present; operating a fan of each of a first indoor unit and a second indoor unit among the plurality of indoor units; determining whether a refrigerant of the first indoor unit is normally circulated and whether a circulation amount of the refrigerant is normal; and determining whether a refrigerant of the second indoor unit is normally circulated, when the determining of at least one of whether the refrigerant of the first indoor unit is normally circulated and whether the circulation amount of the refrigerant is normal is terminated.

Here, the determining of whether the refrigerant of the first indoor unit is normally circulated and whether the circulation amount of the refrigerant is normal may include obtaining an outdoor air temperature and an indoor air temperature of an interior space in which the first indoor unit is installed among the plurality of indoor units, obtaining a difference between an inlet temperature and an outlet temperature of an indoor heat exchanger of the first indoor unit, comparing a reference superheat degree determined using the indoor air temperature of the interior space in which the first indoor unit is installed and the outdoor air temperature and the difference between the inlet temperature and the outlet temperature of the indoor heat exchanger, and determining whether a circulation amount of a refrigerant introduced into the first indoor unit is normal based on a result of the comparison.

Also, the reference superheat degree may be determined based on correlation among the indoor air temperature, the outdoor air temperature, and an actually measured superheat degree.

Also, the reference superheat degree may be determined further using indoor humidity.

Also, the determining of whether the refrigerant of the first indoor unit is normally circulated and whether the circulation amount of the refrigerant is normal may further include obtaining a difference between a temperature of the indoor heat exchanger and the indoor air temperature, comparing the difference between the temperature of the indoor heat exchanger and the indoor air temperature and a first reference value, and comparing the temperature of the indoor heat exchanger and a second reference value.

Also, the determining of whether the refrigerant of the first indoor unit is normally circulated and whether the circulation amount of the refrigerant is normal may include maintaining an operation of the fan of the second indoor unit while determining whether the refrigerant of the first indoor unit is normally circulated and whether the circulation amount of the refrigerant is normal.

Also, the method may further include displaying information about an indoor unit in which the refrigerant is abnormally circulated or the circulation amount of the refrigerant is abnormal among the plurality of indoor units.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 24, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. Hereinafter, an embodiment of an air conditioner will be described with reference to FIGS. 1 to 11.

Figure 1:
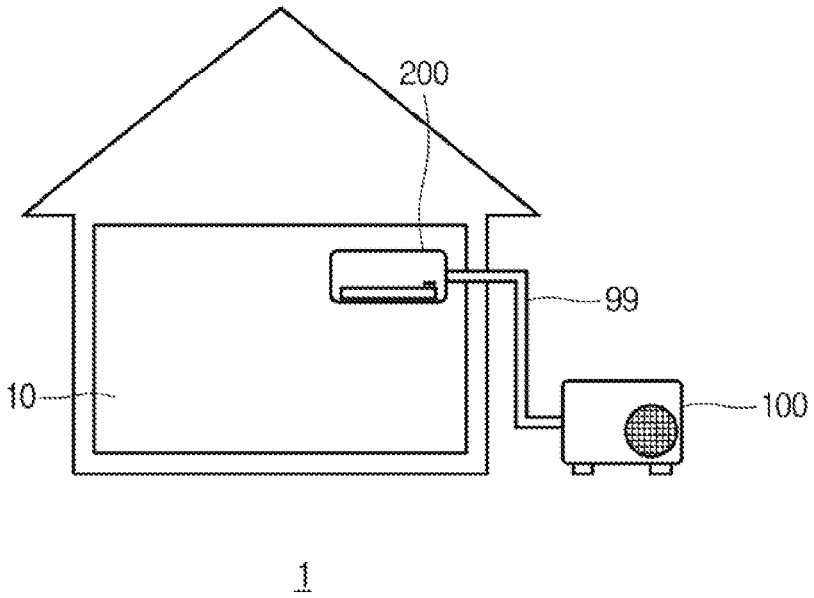
FIG. 1 illustrates an air conditioner according to various embodiments of the present disclosure.

FIG. 1 is a conceptual diagram illustrating an embodiment of an air conditioner.

As illustrated in FIG. 1, an air conditioner 1 may include an outdoor unit 100 that is provided outdoors and an indoor unit 200 that is provided in an interior space 10.

The outdoor unit 100 and the indoor unit 200 may be connected to each other via an external pipe 99, the outdoor unit 100 may compress and condense a flowing refrigerant, and the compressed and condensed refrigerant may be delivered to the indoor unit 200 via the external pipe 99. The indoor unit 200 may evaporates the compressed and condensed refrigerant to cool air, and may adjust a temperature of air of the interior space 10 by discharging the cooled air into the interior space 10. The indoor unit 200 may deliver the evaporated refrigerant to the outdoor unit 100 via the pipe 99 again.

The external pipe 99 connecting the outdoor unit 100 and the indoor unit 200 may include a hollow pipe in which the refrigerant flows and a variety of connection members for connecting a plurality of pipes, and the pipe or the connection member may be implemented using metal, synthetic resin, rubber, or the like. One distal end of the external pipe 99 may be provided so as to extend from pipes 150 and 155 connected to a compressor 110 of the outdoor unit 100, an outdoor heat exchanger 111, such as a condenser, or an electronic expansion valve (EEV) 112. In addition, the other distal end of the external pipe 99 may be provided so as to extend from refrigerant passages 250 and 252 connected to an EEV 210 of the indoor unit 200 or an indoor heat exchanger 211, such as an evaporator.

As the refrigerant, a halogen compound refrigerant such a chlorofluorocarbon (CFC), a hydrocarbon refrigerant, carbon dioxide, ammonia, water, air, an azeotropic refrigerant, chloromethyl, and the like may be used, and a variety of materials which may be considered by the designer may be used as the refrigerant.

Figure 2:
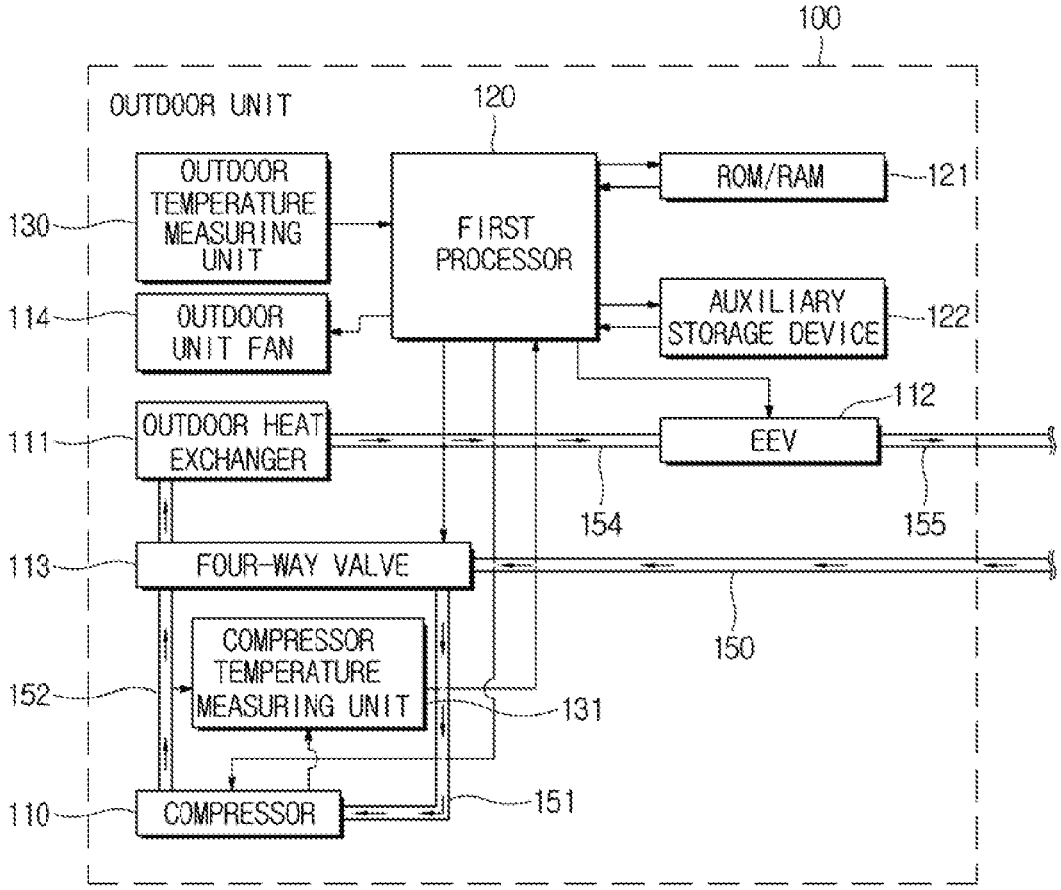
FIG. 2 illustrates an outdoor unit according to various embodiments of the present disclosure.

FIG. 2 is a block diagram illustrating an embodiment of an outdoor unit.

As illustrated in FIG. 2, the outdoor unit 100 may include the compressor 110, the EEV 112, a four-way valve 113, refrigerant passages 150 to 155 for connecting the above to each other, an outdoor unit fan 114, a first processor 120, a main storage device 121 (ROM/RAM), an auxiliary storage device 122, an outdoor temperature measuring unit 130, and a compressor temperature measuring unit 131.

Arrows shown inside the respective refrigerant passages 150 to 155 indicate a flow direction of a refrigerant when the air conditioner 1 performs a cooling operation. When the air conditioner 1 performs a heating operation, the refrigerant may flow in the opposite direction to that shown in FIG. 2. The cooling operation refers to an operation of the air conditioner 1 which is performed in order to reduce the indoor air temperature, and the heating operation refers to an operation which is performed in order to increase the indoor air temperature.

The external pipe 99 enters the inside of the outdoor unit 100 and is connected to the refrigerant passage 150 inside the outdoor unit 100.

The compressor 110 is directly or indirectly connected to refrigerant passages 150 and 151 connected to the external pipe 99, and receives the refrigerant via the refrigerant passages 150 and 151. The refrigerant delivered via the refrigerant passages 150 and 151 may include a refrigerant evaporated in the indoor heat exchanger 211. The compressor 110 may suction the refrigerant supplied via the refrigerant passages 150 and 151, and change the suctioned refrigerant into a high-temperature and high-pressure gas. The high-temperature and high-pressure gas may be delivered to the outdoor heat exchanger 111 via a refrigerant passage 152 connecting the compressor 110 and the outdoor heat exchanger 111.

As the compressor 110, a positive displacement compressor or a dynamic compressor may be adopted and implemented, and various types of compressors which may be considered by the designer may be used.

In order to change the refrigerant into the high-temperature and high-pressure gas, a predetermined motor may be provided in the compressor 110. The motor may be rotated at a predetermined speed according to the control of the first processor 120. When an inverter air compressor is used as the compressor 110, an operating frequency of the motor may be varied, and in this case, the operating frequency of the motor may be determined according to a control signal transmitted from the first processor 120. The cooling capacity of the air conditioner 1 may be changed according to the operating frequency of the motor.

The outdoor heat exchanger 111 may perform the function of the condenser when the air conditioner 1 performs the cooling operation, and liquefy the refrigerant in the high-temperature and high-pressure gaseous state into high-temperature and high-pressure liquid. The refrigerant in the outdoor heat exchanger 111 may discharge heat to the outside while it is liquefied, and therefore the temperature of the refrigerant may be reduced. The refrigerant condensed in the outdoor heat exchanger 111 may be moved to the EEV 112 via refrigerant passages 154 and 155 provided in the outdoor heat exchanger 111.

Conversely, the outdoor heat exchanger 111 may perform the function of the evaporator when the air conditioner 1 performs the heating operation, and the refrigerant may absorb ambient heat while it is evaporated around the outdoor heat exchanger 111.

According to certain embodiments, the outdoor heat exchanger 111 may be implemented using a cooling pipe formed to be bent in a zigzag shape, and in certain cases, one distal end of the cooling pipe may be provided to be connected to the refrigerant passage 152 connected to the compressor 110, and the other distal end thereof may be provided to be connected to the refrigerant passage 154 connected to the EEV 112 of the outdoor unit 100, or connected to an external pipe 155.

As the outdoor heat exchanger 111, various types of condensers such as a water cooled condenser, an evaporative condenser, an air cooled condenser, and the like may be adopted and implemented. In addition, various types of condensers which may be considered by the designer may be used.

The EEV 112 may expand the refrigerant in the high-temperature and high-pressure liquid state and discharge the refrigerant mixed with a low-temperature and low-pressure gas. In addition, the EEV 112 may adjust an amount of the refrigerant introduced into the indoor heat exchanger 211 of the indoor unit 200 according to a control. The refrigerant discharged from the EEV 112 may be delivered to the outdoor unit 100 via the refrigerant passage 155 and the external pipe 99.

As the EEV 112, various types of valves such as a thermoelectric type EEV using the deformation of bimetal, a thermostatic type EEV using volume expansion caused by heating of sealing wax, a pulse-width modulation (PWM) type EEV for opening and closing a solenoid valve by a pulse signal, a step motor type EEV for opening and closing a valve using a motor, etc., may be used.

According to certain embodiments, the EEV 112 of the outdoor unit 100 may be omitted, and in this case, the EEV (210 of FIG. 6) may be provided in the indoor unit 200.

The four-way valve 113 may switch the flow direction of the high-temperature and high-pressure gaseous refrigerant discharged from the compressor 110. In other words, the four-way valve 113 may allow the refrigerant to flow from the compressor 110 to the outdoor heat exchanger 111 during the cooling operation (an arrow direction of FIG. 2), and allow the refrigerant to flow from the outdoor heat exchanger 111 to the compressor 110 during the heating operation (the opposite direction to that in FIG. 2).

The four-way valve 113 may be connected to a first refrigerant passage 150 connected to the external pipe 99, second and third refrigerant passages 151 and 152 connected to the compressor 110, and a fourth refrigerant passage 153 connected to the outdoor heat exchanger 111, so that the flow of the refrigerant may be changed by connecting or cutting off the first to fourth refrigerant passages 150 to 153, as necessary.

Specifically, during the cooling operation, the four-way valve 113 may connect the first refrigerant passage 150 and the second refrigerant passage 151 so that the refrigerant flows into the compressor 110, and connect the third refrigerant passage 152 and the fourth refrigerant passage 153 so that the refrigerant discharged from the compressor 110 may flow into the outdoor heat exchanger 111. Conversely, during the heating operation, the four-way valve 113 may connect the first refrigerant passage 150 and the third refrigerant passage 152 so that the refrigerant discharged from the compressor 110 may flow into the external pipe 99 via the first refrigerant passage 150, and connect the second refrigerant passage 151 and the fourth refrigerant passage 153 so that the refrigerant discharged from the outdoor heat exchanger 111 may flow into the compressor 110.

The four-way valve 113 may be implemented using an electromagnet or the like, and according to an embodiment, it may be omitted.

The outdoor unit fan 114 may perform a function of dissipating heat discharged in accordance with the liquefaction of the refrigerant in the outdoor heat exchanger 111 by discharging air around the outdoor heat exchanger 111 to the outside. The outdoor unit fan 114 may be implemented using one or more blades and a motor for rotating the blade. The outdoor unit fan 114 may be provided in the vicinity of the outdoor heat exchanger 111.

The refrigerant passages 150 to 155 may each have a pipe shape whose inside is empty, and the inner empty space may be used as a passage through which the refrigerant flows. The refrigerant passages 150 to 155 may be made of a material such as metal or rubber.

The first processor 120 may control the overall operations of the outdoor unit 100, and for this, transmit a control signal to various components inside the outdoor unit 100. For example, the first processor 120 may generate a predetermined control signal, that is, an electric signal, and then transmit the generated control signal to the compressor 110, the EEV 112, and the four-way valve 113 via a circuit or a cable, thereby controlling the operations of the compressor 110, the EEV 112, and the four-way valve 113.

For example, the first processor 120 may adjust a circulation rate of the refrigerant by controlling the motor of the compressor 110, and more specifically, adjust the circulation rate of the refrigerant by changing the operating frequency of the motor of the compressor 110.

According to certain embodiments, the first processor 120 may determine and change the operating frequency of the motor of the compressor 110 according to the number of the indoor units 200 to be operated. For this, the first processor 120 may determine the number of the indoor units 200, generate a control signal associated with the change in the operating frequency of the motor according to the determined number of the indoor units 200, and transmit the generated control signal to the motor of the compressor 110 so that the motor may be operated according to the number of the indoor units 200. In this case, the first processor 120 may control the motor to be operated at a predetermined first operating frequency when the number of the indoor units 200 is one, and control the motor to be operated at a second operating frequency larger than the first operating frequency when the number of the indoor units 200 is plural so that the indoor unit 200 may appropriately adjust the indoor temperature.

When the number of the indoor units 200 is changed during an operation such as a trial operation or the like, the first processor 120 may generate a control signal for changing the operating frequency of the motor of the compressor 110 according to the change in the number of the indoor units 200, and transmit the generated control signal to the motor of the compressor 110 to control the motor to be operated at the changed operating frequency.

The first processor 120 may control the operation of the outdoor unit 100 according to its own determination result, or receive a control command or data from a second processor 220 of the indoor unit 200 and control the operation of the outdoor unit 100 according to the received control command or data. In addition, the first processor 120 may transmit the control command or obtained data to the second processor 220 of the indoor unit 200.

In order for the first processor 120 to receive or transmit the control command or data from the second processor 220, a predetermined communication module (not illustrated) may be provided in the outdoor unit 100. The communication module may perform communication using an electric circuit or a cable, or by using a wireless communication network. When using the wireless communication network, the communication module may include an antenna and a wireless communication chip. Here, the wireless communication network may include a short-range wireless communication network which is implemented by a variety of short-range communication technologies such as BLUETOOTH, BLUETOOTH low energy, infrared data association (IrDA), wireless fidelity (Wi-Fi), Wi-Fi direct, ultra wideband (UWB), ZIGBEE, near field communication (NFC), and the like, and include a mobile communication network using a variety of standard wireless communication technologies. Here, the variety of standard wireless communication technologies may be implemented using a variety of wireless communication standards such as 3GPP-based wireless communication standards such as evolved high speed packet access+ (HSPA+) or long-term evolution (LTE), 3GPP2-based wireless communication standards such as code division multiple access (CDMA), Wibro, and the like.

According to certain embodiments, the first processor 120 may determine whether the refrigerant is normally circulated using an indoor air temperature $T_r$ and an inlet temperature $T_{in_1}$ of the indoor heat exchanger, and in this instance, the indoor air temperature $T_r$ and the inlet temperature $T_{in_1}$ of the indoor heat exchanger may be received from the second processor 220. Specifically, the first processor 120 may receive values of the indoor air temperature $T_r$ and the inlet temperature $T_{in_1}$ of the indoor heat exchanger, calculate a difference between the indoor air temperature $T_r$ and the inlet temperature $T_{in_1}$ of the indoor heat exchanger, determine whether the calculated difference exceeds a predefined first reference value $T_a$, and determine whether the refrigerant is normally circulated according to the determination result. The first processor 120 may determine that the refrigerant is normally circulated when the difference therebetween exceeds the first reference value $T_a$, and determine that the refrigerant is abnormally circulated when the difference therebetween is smaller than the first reference value $T_a$. Here, the first reference value $T_a$ may include a value which is arbitrarily determined according to a choice or experience of the designer.

According to another embodiment, the first processor 120 may determine whether the refrigerant is normally circulated using the inlet temperature $T_{in_1}$ of the indoor heat exchanger received from the second processor 220. Specifically, the first processor 120 may determine whether the inlet temperature $T_{in_1}$ of the indoor heat exchanger is smaller than a predefined second reference value $T_{low}$, and determine that the refrigerant is normally circulated when the inlet temperature $T_{in_1}$ of the indoor heat exchanger is the predefined second reference value $T_{low}$ or less. Here, the second reference value $T_{low}$ may include a value which is arbitrarily determined according to a choice or experience of the designer.

The first processor 120 may determine whether the refrigerant is normally circulated by using only a comparison between the difference between the indoor air temperature $T_r$ and the inlet temperature $T_{in_1}$ of the indoor heat exchanger and the first reference value $T_a$, or by using a comparison between the inlet temperature $T_{in_1}$ of the indoor heat exchanger and the second reference value $T_{low}$. In addition, the first processor 120 may determine whether the refrigerant is normally circulated using both.

The first processor 120 may transmit the result of determination whether the refrigerant is normally circulated to the second processor 220 of the indoor unit 200, to which the inlet temperature $T_{in_1}$ of the indoor heat exchanger is to be transmitted, and the second processor 220 may display the transmitted result of the determination of whether the refrigerant is normally circulated to a user by controlling a display unit 240. For this, the first processor 120 may be set to read a variety of data associated with the display of the determination result from the main storage device 121 or the auxiliary storage device 122 and to transmit the read data to the second processor 220. For example, the first processor 120 may read data of a message associated with the normal circulation from the main storage device 121 or the auxiliary storage device 122 when it is determined that the refrigerant is normally circulated, and read data of an error message from the main storage device 121 or the auxiliary storage device 122 when it is determined that the refrigerant is abnormally circulated.

According to certain embodiments, the first processor 120 may determine a reference superheat degree $Z_1$ using the indoor air temperature $T_r$ and an outdoor air temperature $T_o$, calculate a difference between an inlet temperature $T_{in_2}$ and an outlet temperature $T_{out}$ of the indoor heat exchanger, and then compare the difference between the inlet temperature $T_{in_2}$ and the outlet temperature $T_{out}$ of the indoor heat exchanger and the reference superheat degree $Z_1$, thereby determining whether a refrigerant circulation amount is normal. In this case, the first processor 120 may determine whether the refrigerant circulation amount is normal when a predetermined time elapses after determining whether the refrigerant is normally circulated. Here, the predetermined time may be determined in advance by the designer, and determined to be an arbitrary time between approximately 5 to 10 minutes, for example, 6 minutes.

The reference superheat degree $Z_1$ may be determined based on correlation among the indoor air temperature $T_r$, the outdoor air temperature $T_o$, and an actually measured superheat degree X. The first processor 120 may inspect data regarding the correlation among the indoor air temperature $T_r$, the outdoor air temperature $T_o$, and the actually measured superheat degree X in the main storage device 121 or the auxiliary storage device 122, and determine the reference superheat degree $Z_1$ from the given indoor air temperature $T_r$ and the outdoor air temperature $T_o$ using the inspected data.

The superheat degree refers to a state in which the refrigerant absorbs latent heat in the evaporator and overheated, thus becoming a dry saturated gas. Hereinafter, in order to distinguish the reference superheat degree Z calculated and determined by the first processor 120 using the indoor air temperature $T_r$, the outdoor air temperature $T_o$, and the like and a superheat degree that is actually measured using the temperature of the evaporator, for example, the indoor heat exchanger 211, the actually measured superheat degree is referred to as an actually measured superheat degree X.

Figure 3:
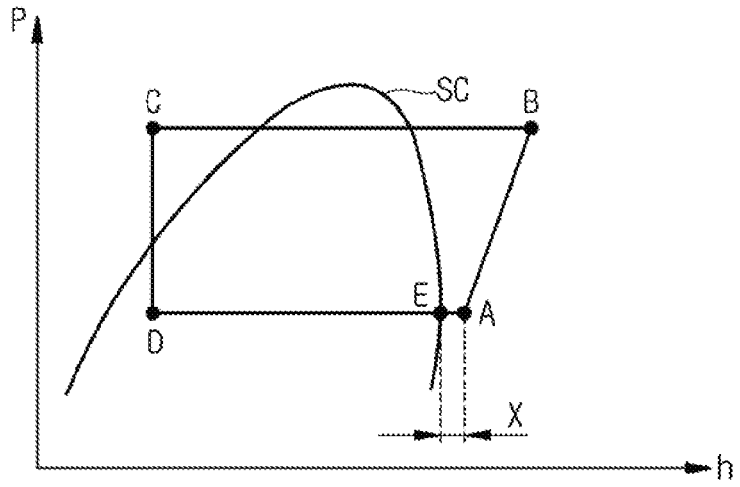
FIG. 3 illustrates an actually measured superheat degree according to various embodiments of the present disclosure.

FIG. 3 is a graph for explaining an actually measured superheat degree, and in FIG. 3, changes in the pressure P and enthalpy h in the cooling cycle are illustrated. In FIG. 3, an X-axis indicates the enthalpy and a Y-axis indicates the pressure.

During the cooling cycle, the pressure and enthalpy at a point A may be returned back to the point A via a point B, a point C, and a point D. Specifically, when the refrigerant is compressed by the compressor 110 (A-B section), the pressure P and enthalpy h of the refrigerant increase together, and when the refrigerant is condensed in the condenser, for example, the outdoor heat exchanger 111 (B-C section), the pressure P shows less change or slightly decreases while the enthalpy h decreases. When the refrigerant is expanded in the EEVs 112 and 210 (C-D section), the enthalpy h shows less change and the pressure P rapidly decreases. When the refrigerant is evaporated in the evaporator, for example, the indoor heat exchanger 211 (D-A section), the pressure P shows less change or slightly decreases while the enthalpy h increases.

Meanwhile, a saturation curve SC has a shape of a convex curve in the upward direction according to the pressure P and the enthalpy h, as illustrated in FIG. 3. The saturation curve SC and a straight line (line segment DA) indicating a change in the pressure P and enthalpy h of the refrigerant in the evaporator cross each other at any one point (point E), and in this instance, the actually measured superheat degree may be given as a temperature difference X between the point A and the point at which the saturation curve SC intersects the straight line (line segment DA) indicating the change in the pressure P and enthalpy h of the refrigerant in the evaporator. Such an actually measured superheat degree X may be measured by obtaining a difference between the inlet temperature $T_{in_2}$ and the outlet temperature $T_{out}$ of the indoor heat exchanger 211.

The saturation curve SC or the like may be changed according to the indoor air temperature $T_r$ and the outdoor air temperature $T_o$, and therefore the actually measured superheat degree X may also be changed. Thus, there may be a correlation among the indoor air temperature $T_r$, the outdoor air temperature $T_o$, and the actually measured superheat degree X, and in this instance, the above-described reference superheat degree $Z_1$ may be determined based on the correlation among the indoor air temperature $T_r$, the outdoor air temperature $T_o$, and the actually measured superheat degree X.

The reference superheat degree $Z_1$ may be obtained using one or more linear relational expression indicating the correlation among the indoor air temperature $T_r$, the outdoor air temperature $T_o$, and the actually measured superheat degree X. The linear relational expression may be obtained experimentally and empirically.

The linear relational expression used to obtain the reference superheat degree Z1 may be defined as the following Equation 1.

$$Z_1=C_0+C_1\cdot T_r+C_2\cdot T_o \quad \text{[Equation 1]}$$

Here, $Z_1$ denotes the reference superheat degree, $T_r$ denotes the indoor air temperature, $T_o$ denotes the outdoor heat temperature, and $C_0$, $C_1$, and $C_2$ are constants. Here, the constants $C_0$, $C_1$, and $C_2$ may be obtained experimentally and empirically.

According to certain embodiments, the constants $C_0$, $C_1$, and $C_2$ may be obtained from the linear relational expression indicating the correlation among the indoor air temperature $T_r$, the outdoor air temperature $T_o$, and the actually measured superheat degree X using regression analysis. Specifically, when performing regression analysis using the given indoor air temperature $T_r$ and the outdoor air temperature $T_o$ as independent variables and the measured actually measured superheat degree X as a dependent variable after the actually measured superheat degree X is measured for each of a plurality of indoor air temperatures $T_r$ and outdoor air temperatures $T_o$ which have been given in advance, the linear relational expression indicating the correlation among the indoor air temperature $T_r$, the outdoor air temperature $T_o$, and the actually measured superheat degree X may be obtained. The constants $C_0$, $C_1$, and $C_2$ of Equation 1 may be determined using the constant of the linear relational expression, a coefficient of the variable $T_r$, and a coefficient of the variable $T_o$. In this case, the constant of the obtained linear relational expression may be determined to be the constant $C_0$, and when the coefficient of the variable $T_r$ is determined to be the constant $C_1$, the coefficient of the variable $T_o$ may be determined to be the constant $C_2$.

The first processor 120 may calculate and determine the reference superheat degree $Z_1$ by applying the indoor air temperature $T_r$ and the outdoor air temperature $T_o$ to the above-described Equation 1, and compare between the inlet temperature $T_{in_2}$ and the outlet temperature $T_{out}$ of the indoor heat exchanger, that is, between the actually measured superheat degree X and the calculated reference superheat degree $Z_1$, thereby determining whether the circulation amount of the refrigerant circulated inside the air conditioner 1 is normal. Here, the magnitude of the inlet temperature inlet temperature $T_{in_2}$ of the indoor heat exchanger may be different from the magnitude of the inlet temperature $T_{in_1}$ of the indoor heat exchanger used to determine whether the refrigerant is normally circulated. This is because the determination of whether the circulation amount of the refrigerant is normal may be performed when a predetermined time elapses after the determination of whether the refrigerant is normally circulated.

When the difference between the inlet temperature $T_{in_2}$ and the outlet temperature $T_{out}$ of the indoor heat exchanger is smaller than or equal to the calculated reference superheat degree $Z_1$, the first processor 120 may determine that the refrigerant circulation amount is normal. Conversely, when the difference between the inlet temperature $T_{in_2}$ and outlet temperature $T_{out}$ of the indoor heat exchanger is larger than the calculated reference superheat degree $Z_1$, the first processor 120 may determine that the refrigerant circulation amount is abnormal. Based on the determination results, the first processor 120 may transmit the related information or a control command to the second processor 220 so that the display unit 240 may output an error message.

According to another embodiment, the first processor 120 may determine a reference superheat degree $Z_2$ by further using an indoor humidity $H_r$ in addition to the indoor air temperature $T_r$ and the outdoor air temperature $T_o$, and after calculating a difference between the inlet temperature $T_{in_2}$ and the outlet temperature $T_{out}$ of the indoor heat exchanger, compare the difference between the inlet temperature $T_{in_2}$ and the outlet temperature $T_{out}$ of the indoor heat exchanger with the reference superheat degree Z to determine whether the circulation amount of the refrigerant is normal.

In this case, the reference superheat degree $Z_2$ may be determined based on a correlation among the indoor air temperature $T_r$, the outdoor air temperature $T_o$, the indoor humidity $H_r$, and the actually measured superheat degree X. The first processor 120 may inspect data of the correlation among the indoor air temperature $T_r$, the outdoor air temperature $T_o$, the indoor humidity $H_r$, and the actually measured superheat degree X in the main storage device 121 or the auxiliary storage device 122, and determine the reference superheat degree $Z_1$ from the given indoor air temperature $T_r$ and outdoor air temperature $T_o$.

In the same manner as in the above-description, the reference superheat degree $Z_2$ may be obtained using a linear relational expression indicating the correlation among the indoor air temperature $T_r$, the outdoor air temperature $T_o$, the indoor humidity $H_r$, and the actually measured superheat degree X, and the linear relational expression may be obtained experimentally and empirically.

The linear relational expression used to obtain the reference superheat degree Z1 may be defined as the following Equation 2.

$$Z_2=C_0+C_1\cdot T_r+C_2\cdot T_o+C_3\cdot H_r \quad \text{[Equation 2]}$$

Here, $Z_2$ denotes the reference superheat degree, $T_r$ denotes the indoor air temperature, $T_o$ denotes the outdoor air temperature, $H_r$ denotes the indoor humidity, and $C_0$, $C_1$, $C_2$, and $C_3$ are constants. Here, the constants $C_0$, $C_1$, and $C_2$ may be obtained experimentally and empirically in the same manner as in the above-description.

In the same manner in the above-description, the constants $C_0$, $C_1$, and $C_2$ may be obtained from the linear relational expression indicating the correlation among the indoor air temperature $T_r$, the outdoor air temperature $T_o$, the indoor humidity $H_r$, and the actually measured superheat degree X using regression analysis. Specifically, when the actually measured superheat degree X is measured for each of a plurality of indoor air temperatures $T_r$, outdoor air temperatures $T_o$, and indoor humidities $H_r$ which have been given in advance, and regression analysis is performed using the measurement result, the linear relational expression indicating the correlation among the indoor air temperature $T_r$, the outdoor air temperature $T_o$, the indoor humidity $H_r$, and the measured actually measured superheat degree X may be obtained, and in this instance, coefficients of the linear relational expression obtained in this manner may be used as $C_0$, $C_1$, and $C_2$ of Equation 2.

The first processor 120 may calculate and determine the reference superheat degree $Z_2$ by applying the indoor air temperature $T_r$, the outdoor air temperature $T_o$, and the indoor humidity $H_r$ to the above-described Equation 2, and compare a difference between the inlet temperature $T_{in_2}$ and the outlet temperature $T_{out}$ of the indoor heat exchanger and the calculated reference superheat degree $Z_2$, thereby determining whether the circulation amount of the refrigerant is normal.

When the difference between the inlet temperature $T_{in_2}$ and the outlet temperature $T_{out}$ of the indoor heat exchanger is smaller than the calculated reference superheat degree $Z_2$, the first processor 120 may determine that the circulation amount of the refrigerant is normal, and conversely, when the difference between the inlet temperature $T_{in_2}$ and the outlet temperature $T_{out}$ of the indoor heat exchanger is the calculated reference superheat degree $Z_2$ or larger, the first processor 120 may determine that the circulation amount of the refrigerant is abnormal. According to the determination result, the first processor 120 may transmit the related information or a control command to the second processor 220 so that the display unit 240 may output an error message.

In the actual installation environment, since the indoor air temperature, the outdoor air temperature, or the indoor humidity may be changed, and the actually measured superheat degree X may be changed depending on the change in the indoor air temperature, the outdoor air temperature, or the indoor humidity, errors are likely to occur when determining whether the circulation amount of the refrigerant is normal by simply comparing the actual measurement superheat degree X and a fixed value. However, when the reference superheat degrees $Z_1$ and $Z_2$ is calculated in consideration of the indoor air temperature $T_r$, the outdoor air temperature $T_o$, or the indoor humidity $H_r$, and the calculated reference superheat degrees $Z_1$ and $Z_2$ and the actually measured superheat degree X are compared, it is possible to determine whether the circulation amount of the refrigerant is appropriate by actively coping with a variety of environments which may appear when actually installed.

In addition, when using the reference superheat degrees $Z_1$ and $Z_2$ as described above, there is no need to obtain a fixed value that is able to be applied in various different environments for every environment made by changing settings of the air conditioner 1 one by one, and therefore time and costs of a trial operation may be reduced.

The first processor 120 may be implemented by one or two or more semiconductor chips and related components, and for example, the first processor 120 may be a central processing unit (CPU). The one or two or more semiconductor chips implementing the first processor 120 may be provided in a printed circuit board installed inside an external housing (140 of FIG. 5), and electrically connect to a variety of components such as the compressor 110 and the like via a circuit formed in the printed circuit board, a separate cable, or the like.

The main storage device 121 and the auxiliary storage device 122 may temporarily or non-temporarily store a variety of information required for the control of the outdoor unit 100, thereby assisting in the operation of the first processor 120. For example, the main storage device 121 may temporarily store one or more of the indoor air temperature $T_r$, the inlet temperatures $T_{in_1}$ and $T_{in_2}$ of the indoor heat exchanger, and a difference therebetween, and the auxiliary storage device 122 may store one or more of the first reference value $T_a$ and the second reference value $T_{low}$.

The outdoor temperature measuring unit 130 may measure the air temperature of the outside in which the outdoor unit 100 is installed, and transmit the measurement result to the first processor 120. The outdoor temperature measuring unit 130 may be implemented using a bimetal thermometer, a thermistor thermometer, an infrared thermometer, or the like. The outdoor temperature measuring unit 130 may be provided outside the external housing 140 of the outdoor unit 100 so as to accurately measure the outdoor air temperature and be installed so as to be spaced apart from the external housing 140 by a predetermined distance, as necessary.

A compressor temperature measuring unit 131 may measure the temperature of the refrigerant discharged from the compressor 110, and transmit the measurement result to the first processor 120. In order to measure the temperature of the refrigerant, the compressor temperature measuring unit 131 may be installed in the refrigerant passages 151 and 152 connected to the compressor 110. The compressor temperature measuring unit 131 may be implemented using a bimetal thermometer, a thermistor thermometer, an infrared thermometer, or the like.

Hereinafter, an example of the physical structure of the outdoor unit will be described.

Figure 4:
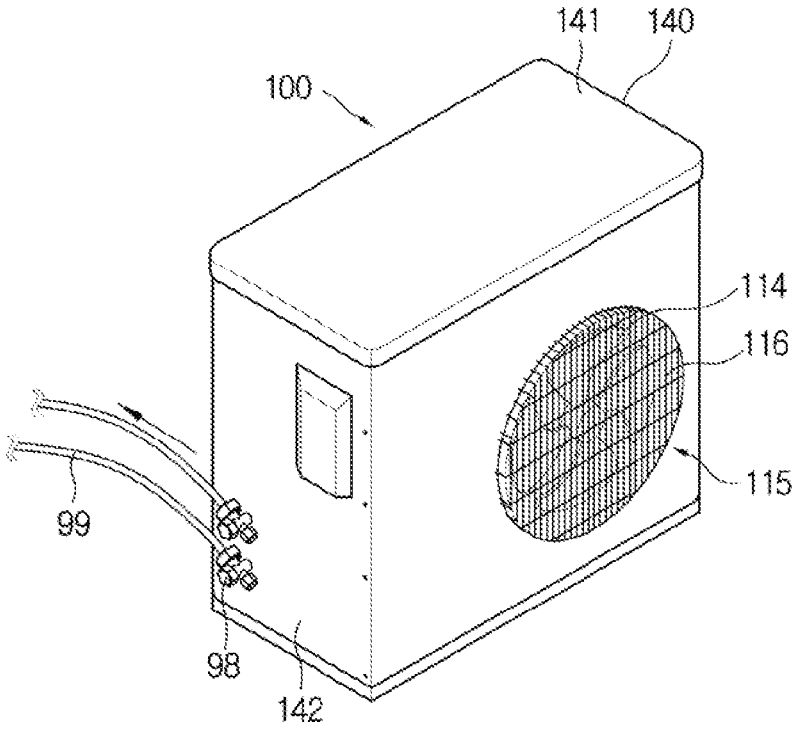
FIG. 4 illustrates the outdoor unit according to various embodiments of the present disclosure.
Figure 5:
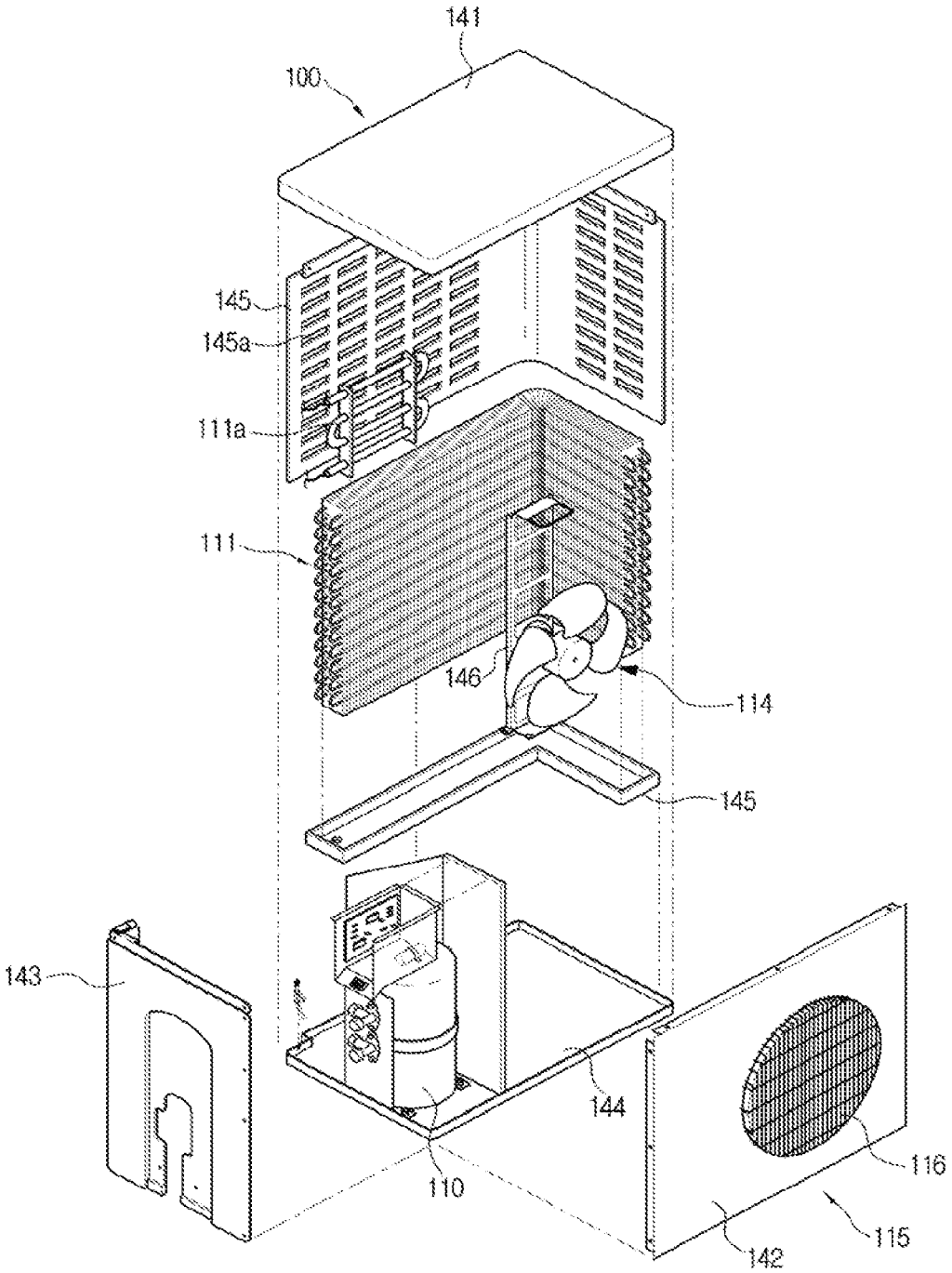
FIG. 5 illustrates the outdoor unit according to various embodiments of the present disclosure.

FIG. 4 is a perspective diagram illustrating various embodiments of the outdoor unit, and FIG. 5 is an exploded perspective diagram illustrating various embodiments of the outdoor unit.

As illustrated in FIGS. 4 and 5, the outdoor unit 100 may include the compressor 110, the outdoor heat exchanger 111, the outdoor unit fan 114, and the refrigerant passage (not illustrated), and the external housing 140, and the external housing 140 may include a top surface housing 141, a front surface housing 142, a side surface housing 143, a bottom surface housing 144, and a rear surface housing 145. The respective housings 141 to 145 are coupled to one another to form an exterior of the outdoor unit 100 and protect various components of the outdoor unit 100 arranged inside the housings 141 and 145 from the outside. According to certain embodiments, two or more of the top surface housing 141, the front surface housing 142, the side surface housing 143, the bottom surface housing 144, and the rear surface housing 145 may be integrally formed.

The compressor 110, the outdoor heat exchanger 111, the outdoor unit fan 114, the refrigerant passage, and the like may be installed inside the external housing 140. The compressor 110 and the outdoor heat exchanger 111 may be installed and fixed on the bottom surface housing 144, and in this case, the outdoor heat exchanger 111 may be coupled to a base panel 145 fixed at the bottom surface housing 144, and thereby may be installed and fixed at the bottom surface housing 144. According to certain embodiments, a defroster 111*a* for melting and removing frost or snow frosted at a surface of the outdoor heat exchanger 111 may be provided in the outdoor heat exchanger 111.

The outdoor unit fan 114 may be installed at an outdoor unit fan support member 146 so as to face a direction of a blowing port 115 and be rotated in a predetermined direction by being coupled to a motor. The motor may be provided at the outdoor unit fan support member 146 so as to rotate the outdoor unit fan 114. The outdoor unit fan support member 146 may be installed and fixed at the bottom surface housing 144.

The blowing port 115 through which air in the housing 140 is discharged to the outside may be provided in the front surface housing 142, and the outdoor unit fan 114 may be exposed to the outside through the blowing port 115. A blocking mesh 116 for preventing direct contact of the outdoor unit fan 114 with the outside may be provided in the front surface of the blowing port 115.

A pipe connecting member 98 in which the external pipe 99 is able to be installed may be formed in the side surface housing 143 and provided to be connected to the refrigerant passages 150 and 155 provided inside the external housing 140.

An inlet 145*a* through which outdoor air is introduced into a space formed inside the housing 140 may be formed in the rear surface housing 145, and the outdoor air introduced into the inlet 145*a* may be discharged to the outside again via the blowing port 115.

The example of the physical structure of the outdoor unit 100 has been described above, but the physical structure of the outdoor unit 100 is not limited to the above-description, and may vary depending on the installation place, the number of connected indoor units 200, and the designer's intension or taste.

Hereinafter, an embodiment of the indoor unit 200 will be described.

Figure 6:
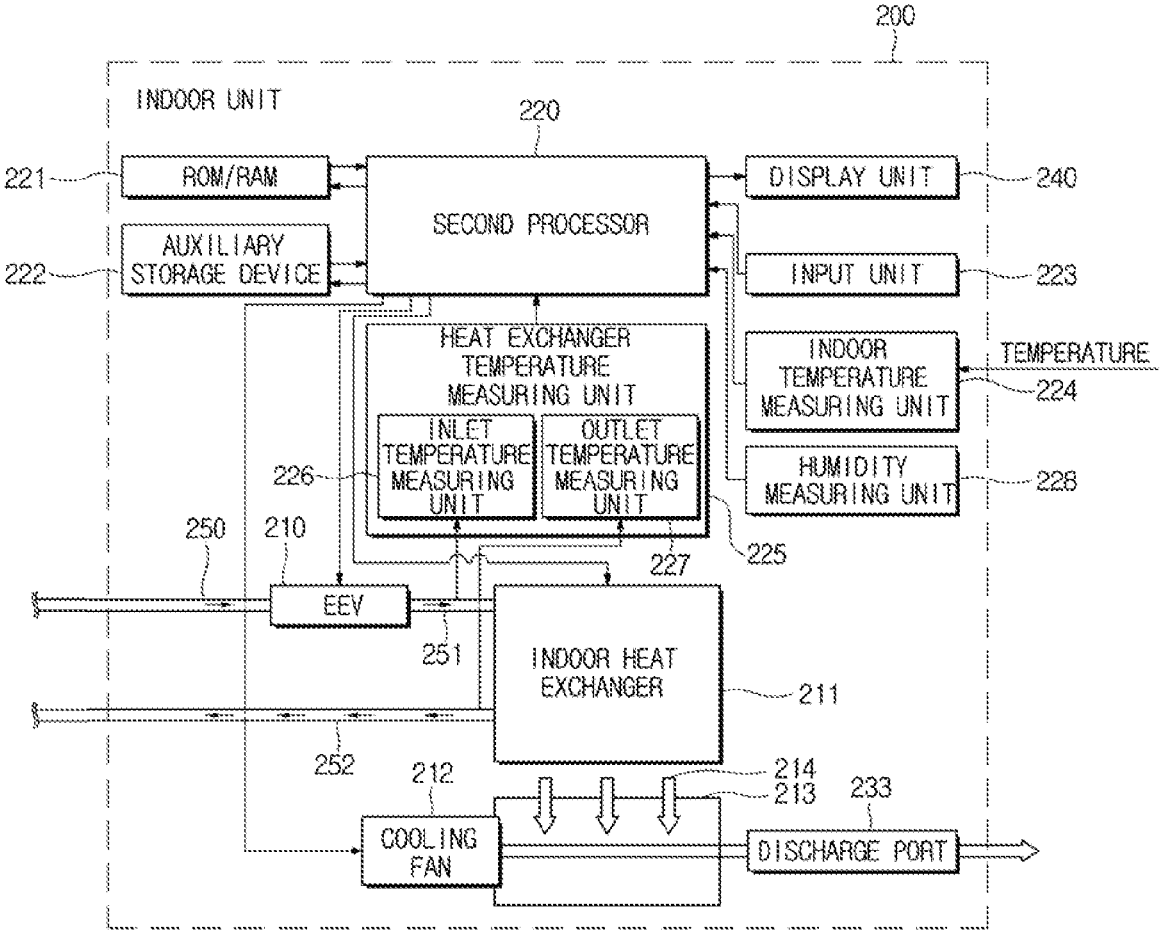
FIG. 6 is illustrates an indoor unit according to various embodiments of the present disclosure.

FIG. 6 is a block diagram illustrating an embodiment of an indoor unit.

As illustrated in FIG. 6, the indoor unit 200 may include the EEV 210, the indoor heat exchanger 211, a cooling fan 212, the second processor 220, the main storage device 221, the auxiliary storage device 222, an input unit 223, an indoor temperature measuring unit 224, a heat exchanger temperature measuring unit 225, a humidity measuring unit 228, the display unit 240, a discharge port 233, and the refrigerant passages 250 to 252.

The external pipe 99 may enter the inside of the indoor unit 200 and be connected to the refrigerant passages 250 and 251 inside the indoor unit 200, and the refrigerant passages 250 and 251 inside the indoor unit 200 connected to the external pipe 99 may be provided to be connected to the EEV 210 or the indoor heat exchanger 211.

The EEV 210 may be connected to the refrigerant passage 250 connected to the external pipe 99, and receive the refrigerant in the high-temperature and high-pressure liquid state from the outdoor unit 100 via the refrigerant passage 250. The EEV 210 may discharge the refrigerant in which low-temperature and low-pressure gas and liquid are mixed with each other by expanding the received refrigerant in the high-temperature and high-pressure liquid state, and adjust an amount of the refrigerant introduced into the indoor heat exchanger 211 of the indoor unit 200.

As the EEV 210, various types of valves such as a thermoelectric type EEV using the deformation of bimetal, a thermostatic type EEV using volume expansion caused by heating of sealing wax, a PWM type EEV for opening and closing a solenoid valve by a pulse signal, a step motor type EEV for opening and closing a valve using a motor, etc., may be used.

According to certain embodiments, the EEV 210 of the indoor unit 200 may be omitted.

The refrigerant discharged from the EEV 210, in which the low-temperature and low-pressure gas and liquid are mixed with each other, may be delivered to the evaporator via the refrigerant passage 251.

The indoor heat exchanger 211 discharges cold air 214. Specifically, when the refrigerant absorbs latent heat by evaporating while it passes through the indoor heat exchanger 211, the temperature of the air of an internal space 213 of the indoor unit 200 may drop. Accordingly, the indoor heat exchanger 211 may discharge the cold air 214 to the internal space 213 of the indoor unit 200. The indoor heat exchanger 211 may include a flow path through which the refrigerant flows, and the flow path may be implemented using a tubular body made of metal or synthetic resin. The tubular body may be bent a plurality of times and have a zigzag shape.

The refrigerant evaporated in the indoor heat exchanger 211 may be discharged to the external pipe 99 via the refrigerant passage 252 connected to each of the indoor heat exchanger 211 and the external pipe 99, and the refrigerant discharged to the external pipe 99 may be delivered to the outdoor unit 100. The refrigerant delivered to the outdoor unit 100 may be introduced into the compressor 110 again via the refrigerant passages 150 and 151 provided in the outdoor unit 100.

The cooling fan 212 may allow the cold air 214 discharged to the internal space 213 to be moved in the direction of the discharge port 233 so that the cold air 214 may be discharged to the internal space via the discharge port 233. The cooling fan 212 may include one or more blades and a motor for rotating the blade, and the cold air 214 may be more strongly discharged via the discharge port 233 depending on a rotational speed of the motor.

The second processor 220 may control the overall operations of the indoor unit 200 by transmitting a control signal to respective components of the indoor unit 200. For example, the second processor 220 may control the cooling fan 212 to be operated, the EEV 210 to be opened or closed, or the display unit 240 to display a specific image. The control signal generated in the second processor 220 may be transmitted to the respective components via a circuit or a cable.

According to certain embodiments, when a trial operation of the air conditioner 1 starts by an input of a trial operation start command from a user, the second processor 220 may transmit a control signal to the cooling fan 212 so that the cooling fan 212 may be rotated at a predetermined speed. Air is discharged to the room via the discharge port 233 according to the rotation of the cooling fan 212. In this case, when the compressor 110 is not operated, the indoor heat exchanger 211 fails to discharge the cold air 214 to the internal space 213, and therefore the indoor unit 200 may perform only a blowing operation. When the cooling fan 212 is operated without the operation of the compressor 110 in this manner, a temperature sensor of the indoor temperature measuring unit 224 is saturated up to an indoor temperature, and therefore determination errors may be reduced.

Meanwhile, the second processor 220 may confirm whether the cooling fan 212 is normally operated in response to the control signal, and determine whether an error occurred in the related component based on the confirmation result. When it is determined that an error occurred in a component based on the confirmation result, the second processor 220 may display the occurrence of the error through the display unit 240, and terminate the trial operation by stopping the operations of the respective components.

According to certain embodiments, the second processor 220 may determine whether the refrigerant is normally circulated through the same method as that in the first processor 120, or calculate the reference superheat degrees $Z_1$ and $Z_2$ and determine whether the circulation amount of the refrigerant is normal using the reference superheat degrees $Z_1$ and $Z_2$. This has been already described in detail through the first processor 120, and separate description thereof will be omitted.

The second processor 220 may perform communication with the first processor 120 of the outdoor unit 100 or a processor of another outdoor unit in a wired manner or through a wireless communication network, and for this, one or more communication modules (not illustrated) may be provided in the indoor unit 200.

When the trial operation start command is input from a user, the second processor 220 may transmit the trial operation start command to the processor of the other outdoor unit, and the processor of the other outdoor unit may start the trial operation according to the transmitted trial operation start command.

In addition, the second processor 220 may transmit, to the first processor 120, a variety of data collected through the heat exchanger temperature measuring unit 255, the indoor temperature measuring unit 224, or the humidity measuring unit 228, for example, the inlet temperatures $T_{in_1}$ and $T_{in_2}$ of the indoor heat exchanger, the outlet temperature $T_{out}$, the indoor air temperature $T_r$, or the indoor humidity $H_r$. The first processor 120 may determine whether the refrigerant is normally circulated using the transmitted variety of data, or calculate the reference superheat degrees $Z_1$ and $Z_2$ and determine whether the circulation amount of the refrigerant is normal using the reference superheat degrees $Z_1$ and $Z_2$.

The second processor 220 may be implemented by one or two or more semiconductor chips and related components. The one or two or more semiconductor chips implementing the second processor 220 may be provided in a printed circuit board installed inside an external housing (230 of FIG. 7), and may be electrically connected to a variety of components inside the indoor unit 200 via a circuit formed in the printed circuit board, a separate cable, or the like.

The main storage device 221 and the auxiliary storage device 222 may temporarily or permanently store a variety of information required for the control of the indoor unit 200, thereby assisting in the operation of the second processor 220. For example, the main storage device 221 may temporarily store one or more of the rotational speed of the cooling fan 212, the indoor air temperature $T_r$ obtained by the indoor temperature measuring unit 224, the inlet temperatures $T_{in_1}$ and $T_{in_2}$ or the outlet temperature $T_{out}$ of the indoor heat exchanger measured by the heat exchanger temperature measuring unit 225, and a difference therebetween.

The input unit 223 may receive a variety of commands for the control of the air conditioner 1 from the user. The input unit 223 may be provided at an outer surface of the external housing 230 of the indoor unit 200 for the convenience of a user's operation. The input unit 223 may include one or more of a keyboard, a mouse, a trackball, a knob, a touch pad, a paddle, various levers, a handle, a joystick, and a touch screen, and may also include a variety of devices that are able to generate an electrical signal according to a user's operation and directly or indirectly transmit the generated electrical signal to the first processor 120 or the second processor 220.

The indoor temperature measuring unit 224 may measure the indoor air temperature, that is, the temperature of the air of the interior space 10 in which the indoor unit 200 is installed, and transmit the measurement result to the second processor 220. As the indoor temperature measuring unit 224, a bimetal thermometer, a thermistor thermometer, an infrared thermometer, or the like may be adopted. The indoor temperature measuring unit 224 may be provided at the outer surface of the external housing 230 of the indoor unit 200 for the accuracy and convenience of the measurement of the indoor air temperature, and more specifically, provided in a front surface of the external housing 230.

The heat exchanger temperature measuring unit 225 may measure the temperature of the refrigerant introduced into the indoor heat exchanger 211, that is, the inlet temperatures $T_{in_1}$ and $T_{in_2}$, or the temperature of the refrigerant discharged from the indoor heat exchanger 211, that is, the outlet temperature $T_{out}$. For this, the heat exchanger temperature measuring unit 225 may include an inlet temperature measuring unit 226 and an outlet temperature measuring unit 227.

The inlet temperature measuring unit 226 may be provided to be brought into contact with an inlet of the indoor heat exchanger 211 or be installed in the vicinity of the inlet so that the inlet temperatures $T_{in_1}$ and $T_{in_2}$ may be measured. Here, the inlet of the indoor heat exchanger 211 may be connected to the refrigerant passage 251 for delivering the refrigerant to the indoor heat exchanger 211 in the cooling process. According to certain embodiments, the inlet temperature measuring unit 226 may be installed to be brought into contact with or adjacent to the refrigerant passage 251.

The outlet temperature measuring unit 227 may be installed to be brought into contact with an outlet of the indoor heat exchanger 211 or be installed in the vicinity of the outlet so that the outlet temperature $T_{out}$ may be measured. Here, the outlet of the indoor heat exchanger 211 may be provided to be connected to the refrigerant passage 252 through which the refrigerant discharged in the cooling process flows. According to certain embodiments, the outlet temperature measuring unit 227 may be provided to be brought into contact with or adjacent to the refrigerant passage 252 through which the discharged refrigerant flows.

The inlet temperature measuring unit 226 and the outlet temperature measuring unit 227 may be implemented using a bimetal thermometer, a thermistor thermometer, an infrared thermometer, or the like, and output an electrical signal equivalent to the measurement result to the second processor 220.

The humidity measuring unit 228 may measure the humidity $H_r$ of the interior space 10. The humidity measuring unit 228 may transmit an electrical signal equivalent to the measured humidity $H_r$ to the second processor 220, and the second processor 220 may determine the reference superheat degree $Z_2$ based on the measured humidity $H_r$, or transmit the measured humidity $H_r$ to the first processor 120 so that the first processor 120 may determine the reference superheat degree $Z_2$. The humidity measuring unit 228 may be provided in the outer surface of the external housing 230 of the indoor unit 200 in order to accurately measure the indoor humidity $H_r$, and more specifically, provided in the front surface of the external housing 230.

The humidity measuring unit 228 may be implemented using a psychrometer, a dew point hygrometer, a resistive polymer thin film hygrometer, or a capacitive polymer thin-film hygrometer, and also implemented using various types of hygrometers which may be considered by the designer.

The display unit 240 may display a variety of information for the state of the air conditioner 1 or the user convenience to the outside. The display unit 240 may display a variety of information about whether the trial operation is normally completed, whether an error occurred in the air conditioner 1, the type of the error that occurred in the air conditioner 1, solutions for the occurred error to the user, so that the user may readily determine the state of the air conditioner 1.

The display unit 240 may be implemented using a plasma display panel (PDP), a light emitting diode (LED) display, a liquid crystal display (LCD), or the like. The LED may include an organic light emitting diode (OLED).

According to certain embodiments, an illuminator (not illustrated) or a sound output device (not illustrated) may be further provided in the indoor unit 200 in order to provide a variety of information for the state of the air conditioner 1 or the user convenience to a user. The illuminator may be implemented using a variety of light emitting means such as an LED illuminator or the like, and the sound output device may be implemented using a speaker or the like.

Hereinafter, a wall-mounted indoor unit 200 will be described as an example of the indoor unit 200.

Figure 7:
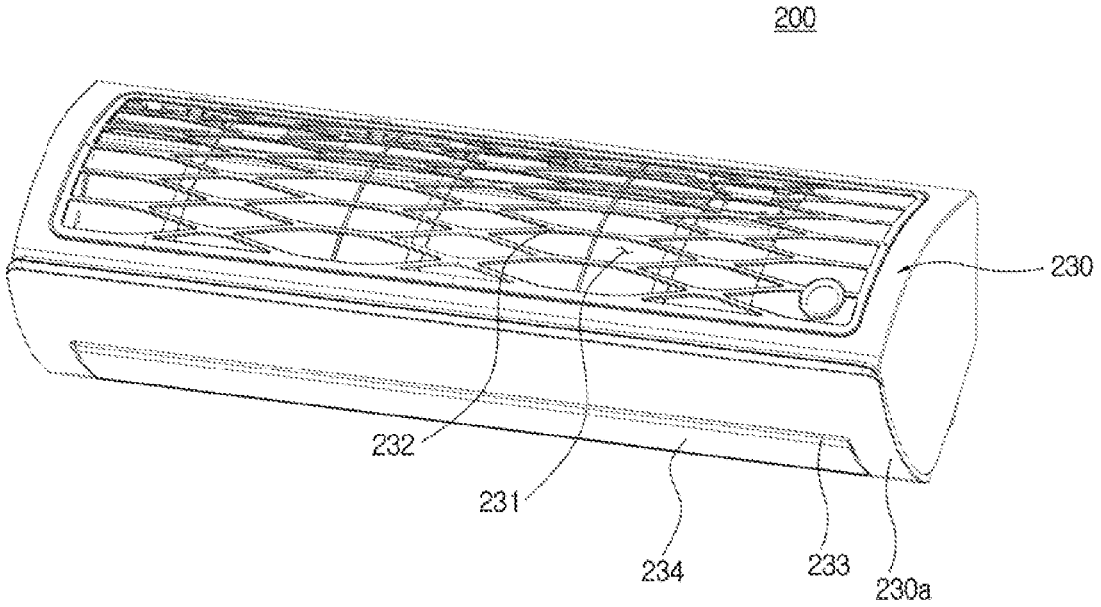
FIG. 7 illustrates an indoor unit according to various embodiments of the present disclosure.
Figure 8:
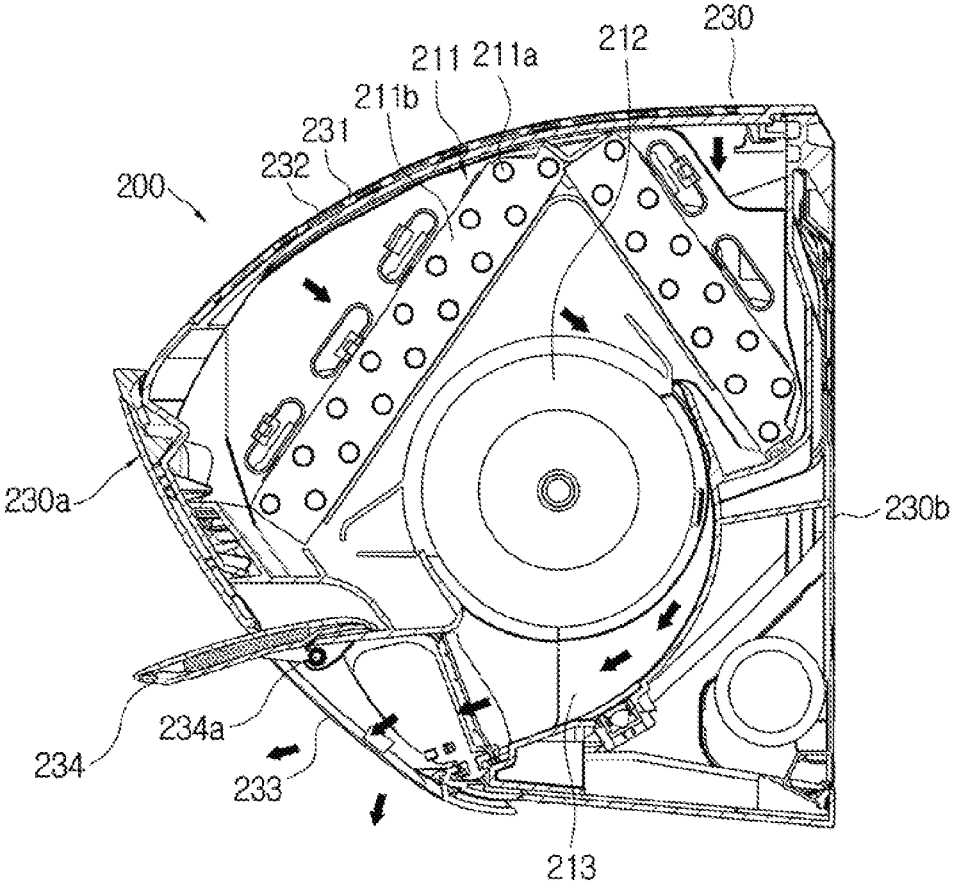
FIG. 8 illustrates the indoor unit according to various embodiments of the present disclosure.

FIG. 7 is a perspective diagram illustrating an embodiment of an indoor unit, and FIG. 8 is a side cross-sectional diagram illustrating various embodiments of the indoor unit.

Referring to FIGS. 7 and 8, the indoor unit 200 may be a wall-mounted indoor unit that is mounted at an inner wall of the interior space 10 and adjusts the temperature of the interior space 10 by discharging the cold air 214 to the interior space 10.

Such an indoor unit 200 may include housings 230, 230*a*, and 230*b*, an inlet 231, the indoor heat exchanger 211, the cooling fan 212, the discharge port 233, and an opening and closing member 234.

The front surface housing 230, the bottom surface housing 230*a*, and the rear surface housing 230*b* may be coupled to each other to form an appearance of the indoor unit 200, and may be equipped with various components required for the operation of the indoor unit 200.

The inlet 231 for suctioning indoor air may be provided in one surface of the front surface housing 230, and a filter 232 for filtering foreign substances included in the suctioned air may be provided in the inlet 231.

The indoor heat exchanger 211 may be built into the indoor unit 200 and allow the indoor air suctioned through the inlet 231 and the refrigerant to be heat exchanged with each other. The indoor heat exchanger 211 may include a tubular body 211*a* through which the refrigerant flows and a heat exchange fin 211*b* that is brought into contact with the tubular body 211*a* to enlarge a heat radiating area, and may also allow hot air suctioned in the room to be brought into contact with the tubular body 211*a* and the heat exchange fin 211*b* so that heat exchange may be performed.

The cooling fan 212 is built into the indoor unit 200 and allows air to be moved in the direction of the discharge port 233. When the refrigerant flows in the indoor heat exchanger 211, the cooling fan 212 may allow air 214 cooled by the heat exchange with the refrigerant to be moved in the direction of the discharge port 233 so that the cooled air 214 may be discharged to the interior space 10. When the refrigerant does not flow in the indoor heat exchanger 211, the cooling fan 212 may allow air that is not cooled to be moved in the direction of the discharge port 233.

According to certain embodiments, the cooling fan 212 may have a cylindrical shape in which a plurality of blades are formed in an outer circumferential surface, and a motor may be provided at one or more distal ends of the cylinder so that the cylinder may be rotated with respect to the center axis.

The discharge port 233 may discharge the cooled air 214 to the outside. The discharge port 233 may be formed on one surface of the bottom surface housing 230*a*.

An opening and closing member 234 for opening and closing the discharge port 233 may be formed in the discharge port 233, and the air moved by the cooling fan 212 may be discharged to the interior space 10 or not discharged by the opening and closing member 234. The opening and closing member 234 may be coupled to the bottom surface housing 230*a* so as to be rotated through a hinge 234*a* to open and close the discharge port 233.

Meanwhile, a pipe connecting member (not illustrated) to which the external pipe 99 is able to be coupled may be formed at an outer surface of the indoor unit 200, and extend from the refrigerant passages 250 to 252 provided inside the housings 230 to 230*b*. Accordingly, the refrigerant transmitted from the outdoor unit 100 may be introduced into the EEV 210 or the indoor heat exchanger 211, and the refrigerant discharged from the indoor heat exchanger 211 may be moved to the outdoor unit 100.

The example of the wall-mounted indoor unit 200 has been described as the indoor unit 200 above, but is not limited thereto. According to an embodiment, as examples of the above-described indoor unit 200, a stand type indoor unit that stands in one place of the interior space 10, a window type indoor unit that is installed in a window, or a ceiling mounted indoor unit that is mounted in a ceiling may be given.

Hereinafter, an embodiment in which a plurality of indoor units 200 to 203 are provided will be described.

Figure 9:
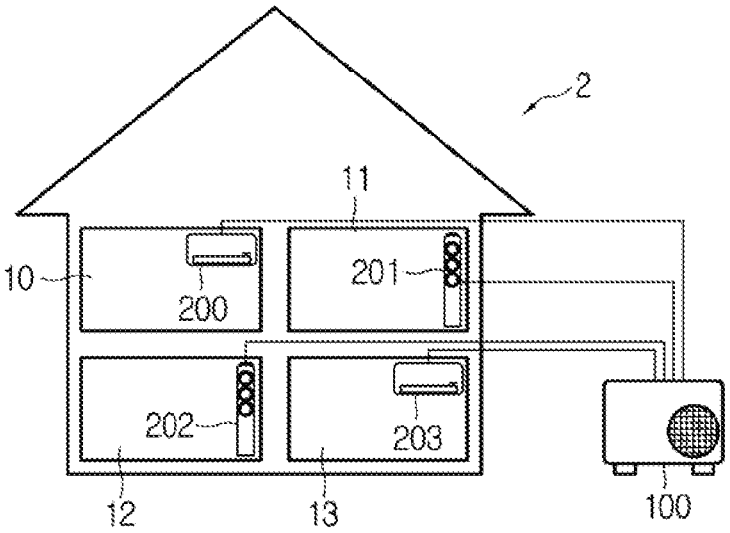
FIG. 9 illustrates a plurality of indoor units connected to one outdoor unit according to various embodiments of the present disclosure.
Figure 10:
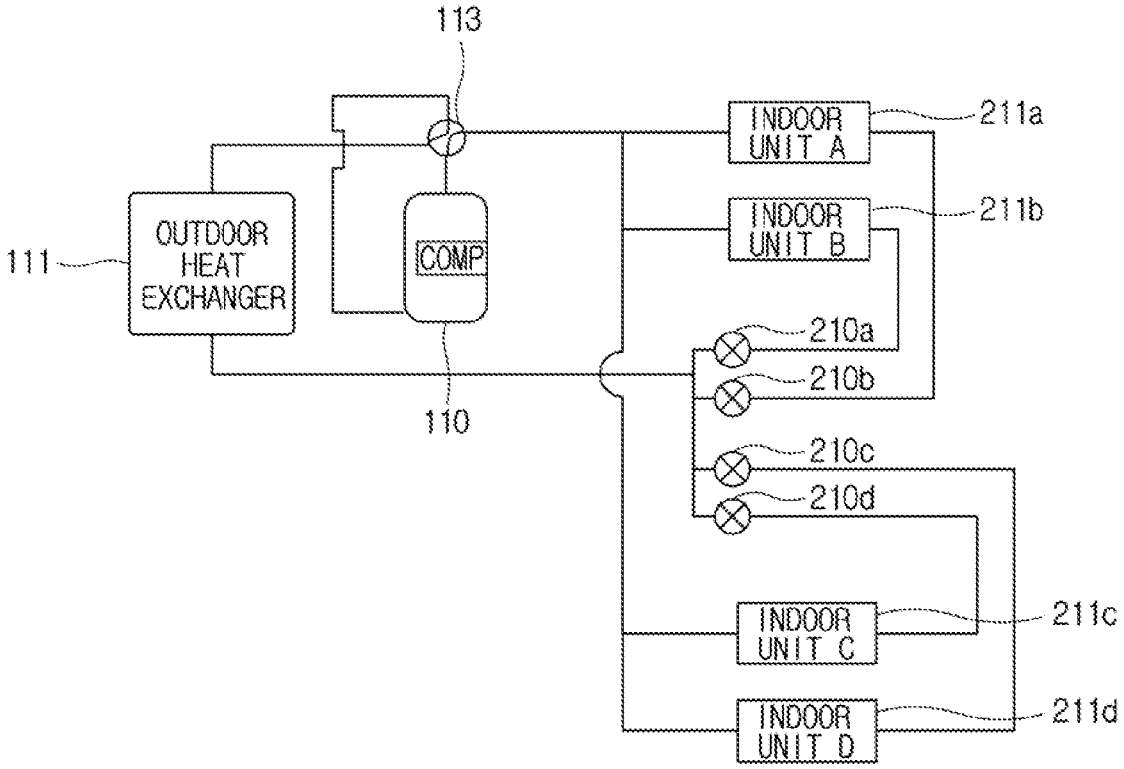
FIG. 10 illustrates an air conditioner in which a plurality of indoor units are connected to one outdoor unit according to various embodiments of the present disclosure.

FIG. 9 is a diagram illustrating an example of an air conditioner 2 in which a plurality of indoor units are connected to a single outdoor unit, and FIG. 10 is a diagram for explaining an embodiment of an air conditioner in which a plurality of indoor units are connected to the single outdoor unit.

As illustrated in FIGS. 9 and 10, a single outdoor unit 100 may be connected to a plurality of indoor units 200 to 203.

The compressor 110 and the outdoor heat exchanger 111 may be provided in the outdoor unit 100, and a motor of the compressor 110 may be operated at an operating frequency larger than that in a case in which one indoor unit 200 is connected to one outdoor unit 100 so that the indoor air temperature of each of the interior spaces 10 to 13 may be appropriately adjusted. According to certain embodiments, the four-way valve 113 for changing the flow direction of the refrigerant may be further provided in the outdoor unit 100.

The plurality of indoor units 200 to 203 may perform a function of adjusting the indoor air temperature of the interior spaces 10 to 13 in which the plurality of indoor units 200 to 203 are respectively installed, and indoor heat exchangers 211*a* to 211*d* may be respectively provided for each of the plurality of indoor units 200 to 203. In addition, EEVs 210*a* to 210*d* may be respectively provided for each of the plurality of indoor units 200 to 203. The plurality of EEVs 210*a* to 210*d* may be built into the corresponding indoor units 200 to 203, or installed outside the indoor units 200 to 203. According to certain embodiments, one outdoor unit 100 may be equipped with the plurality of EEVs 210*a* to 210*d*.

As illustrated in FIGS. 9 and 10, when the plurality of indoor units 200 to 203 are coupled to the one outdoor unit 100, refrigerant passages of the single outdoor unit 100 may be connected to refrigerant passages of the plurality of indoor units 200 to 203, and for this connection, a branch pipe may be provided between the refrigerant passage of the single outdoor unit 100 and the refrigerant passages of the plurality of indoor units 200 to 203.

When the plurality of indoor units 200 to 203 are coupled to the single outdoor unit 100, the first processor 120 or the second processor 220 may control the other second to fourth indoor units 201 to 203 to be also operated according to the operation of the first indoor unit 200. For example, when the first indoor unit 200 starts a trial operation, the first processor 120 or the second processor 220 may allow the other indoor units 201 to 203 to also perform the trial operation by transmitting a control signal to the second to fourth indoor units 201 to 203.

When the first indoor unit 200 performs a predetermined operation, the second to fourth indoor units 201 to 203 may perform the same operation as that of the first indoor unit 200.

For example, when the first indoor unit 200 starts the trial operation so that the cooling fan 212 of the first indoor unit 200 is rotated to blow without a heat exchange of the indoor heat exchanger 211, the second to fourth indoor units 201 to 203 may start the trial operation in the same manner as that in the first indoor unit 200, thereby performing blowing.

In addition, when the first indoor unit 200 performs a predetermined operation, the second to fourth indoor units 201 to 203 may perform a different operation from that of the first indoor unit 200.

When the first indoor unit 200 completes the blowing, the outdoor unit 100 connected to the first indoor unit 200 may determine whether the refrigerant between the first indoor unit 200 and the outdoor unit 100 is normally circulated, and then, the first indoor unit 200 or the outdoor unit 100 may determine whether the circulation amount of the refrigerant is appropriate. In this case, the second to fourth indoor units 201 to 203 may maintain the blowing without stopping the blowing.

When the determination of whether the refrigerant is normally circulated or the determination of whether the circulation amount of the refrigerant is appropriate is terminated, the outdoor unit 100 may determine whether the refrigerant between the second indoor unit 201 and the outdoor unit 100 is normally circulated, and in this case, the third and fourth indoor units 202 and 203 may continue to maintain the blowing.

In this manner, the plurality of indoor units 200 to 204 may perform different operations from those of the other indoor units 200 to 204 according to the operations of the other indoor units 200 to 204 or the outdoor unit 100.

Figure 11:
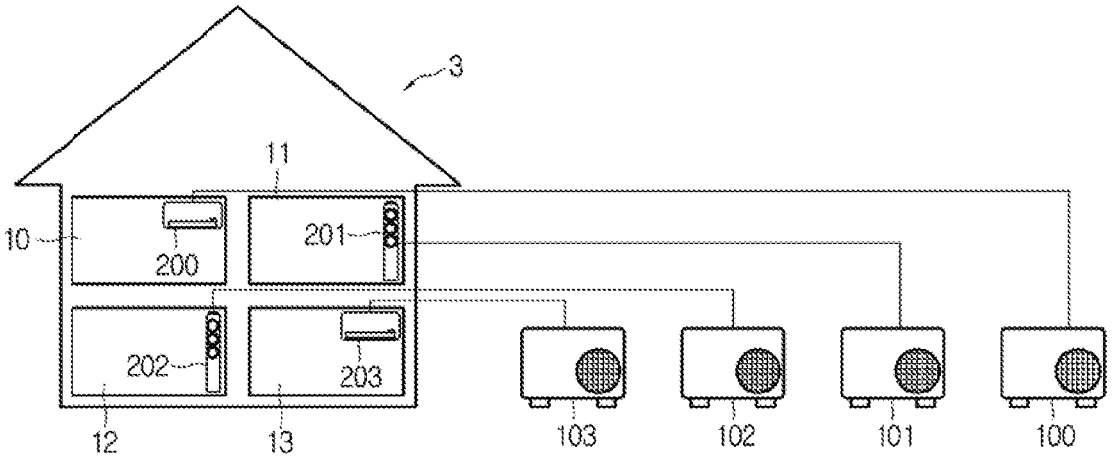
FIG. 11 illustrates an example of an air conditioner in which the plurality of indoor units are connected to a plurality of outdoor units according to various embodiments of the present disclosure.

FIG. 11 is a diagram illustrating an example of an air conditioner in which the plurality of indoor units are connected to a plurality of outdoor units.

As illustrated in FIG. 11, a plurality of corresponding outdoor units 100 to 103 may be provided for each of the plurality of indoor units 200 to 203, and the plurality of outdoor units 100 to 103 may be respectively connected to the plurality of corresponding indoor units 200 to 203. In this case, the respective outdoor units 100 to 103 may be operated independently from one another, and the respective indoor units 200 to 203 may be also operated independently from one another. Accordingly, the trial operations of the respective indoor units 200 to 203 may be also performed independently from one another.

Hereinafter, an embodiment of a method for controlling an air conditioner will be described with reference to FIGS. 12 to 25.

Figure 12:
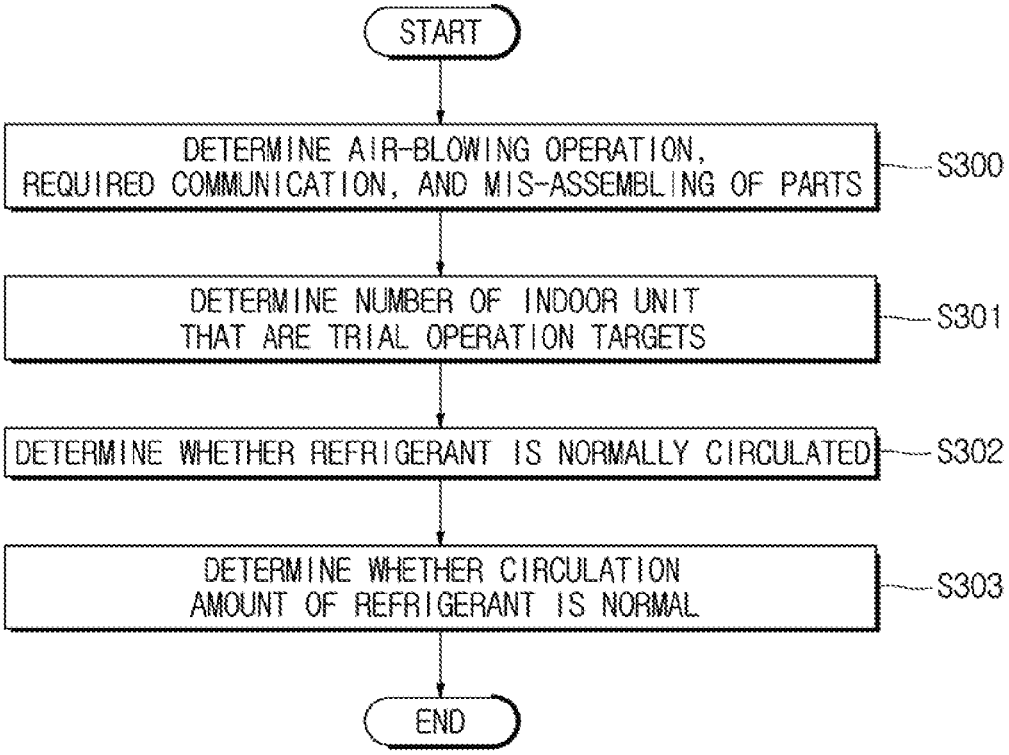
FIG. 12 illustrates a method for controlling an air conditioner according to various embodiments of the present disclosure.

FIG. 12 is a flowchart illustrating an embodiment of a method for controlling an air conditioner.

The method for controlling the air conditioner illustrated in FIG. 12 may be used to inspect whether the air conditioner 1 is normally operated by performing the trial operation of the air conditioner 1.

Specifically, as illustrated in FIG. 12, the method for controlling the air conditioner may include an operation S300 of blowing, an operation S301 of determining the number of indoor units, an operation S302 of determining whether a refrigerant is normally circulated, and an operation S303 of determining whether a circulation amount of the refrigerant is normal.

In the operation S300 of blowing, when a trial operation start command is input by the input unit 223 from a user, the indoor unit 200 may operate only the cooling fan 212 for a predetermined time without the operation of the indoor heat exchanger 211, thereby discharging air through the discharge port 233.

According to certain embodiments, the second processor 220 of the indoor unit 200 may determine whether the cooling fan 212 is normally operated while the operation S300 of blowing proceeds, and determine whether parts are wrongly assembled or whether a defect such as short circuit or the like is present based on the determination result.

In addition, the second processor 220 may transmit an electrical signal to the first processor 120 of the outdoor unit 100 while the operation S300 of blowing proceeds and determine whether an electrical signal corresponding to the transmitted signal is transmitted from the first processor 120, thereby further determining whether the first processor 120 and the second processor 220 are able to communicate with each other.

Figure 13:
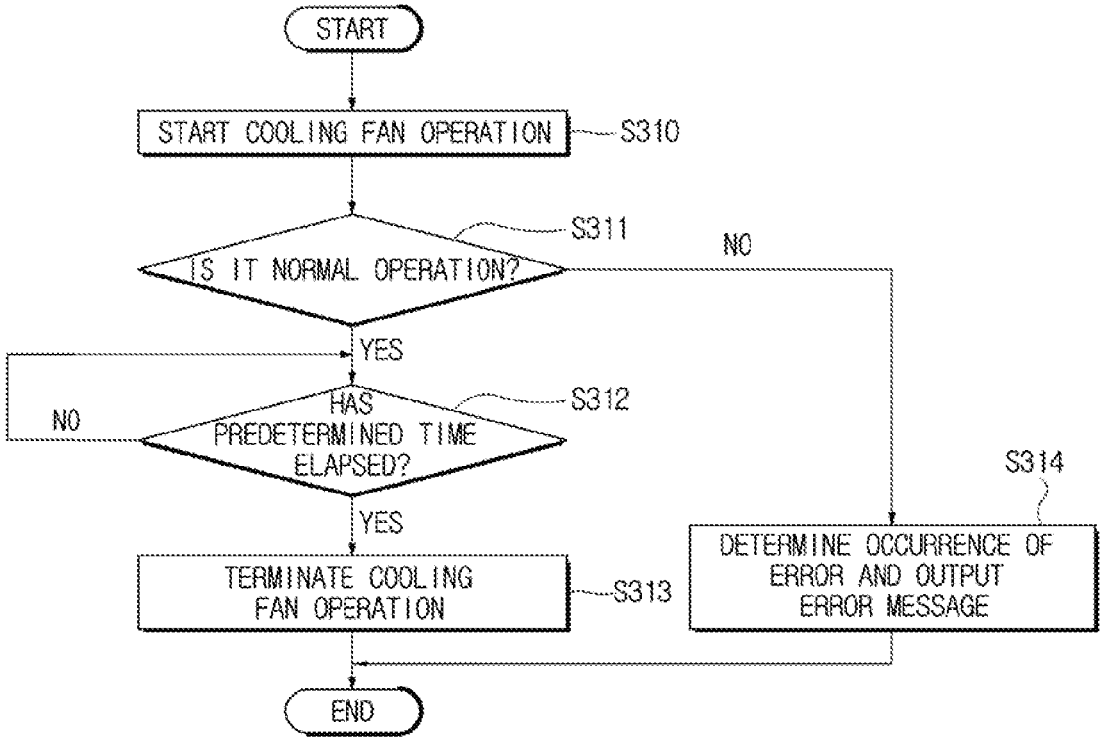
FIG. 13 illustrates a blowing operation according to various embodiments of the present disclosure.
Figure 14:
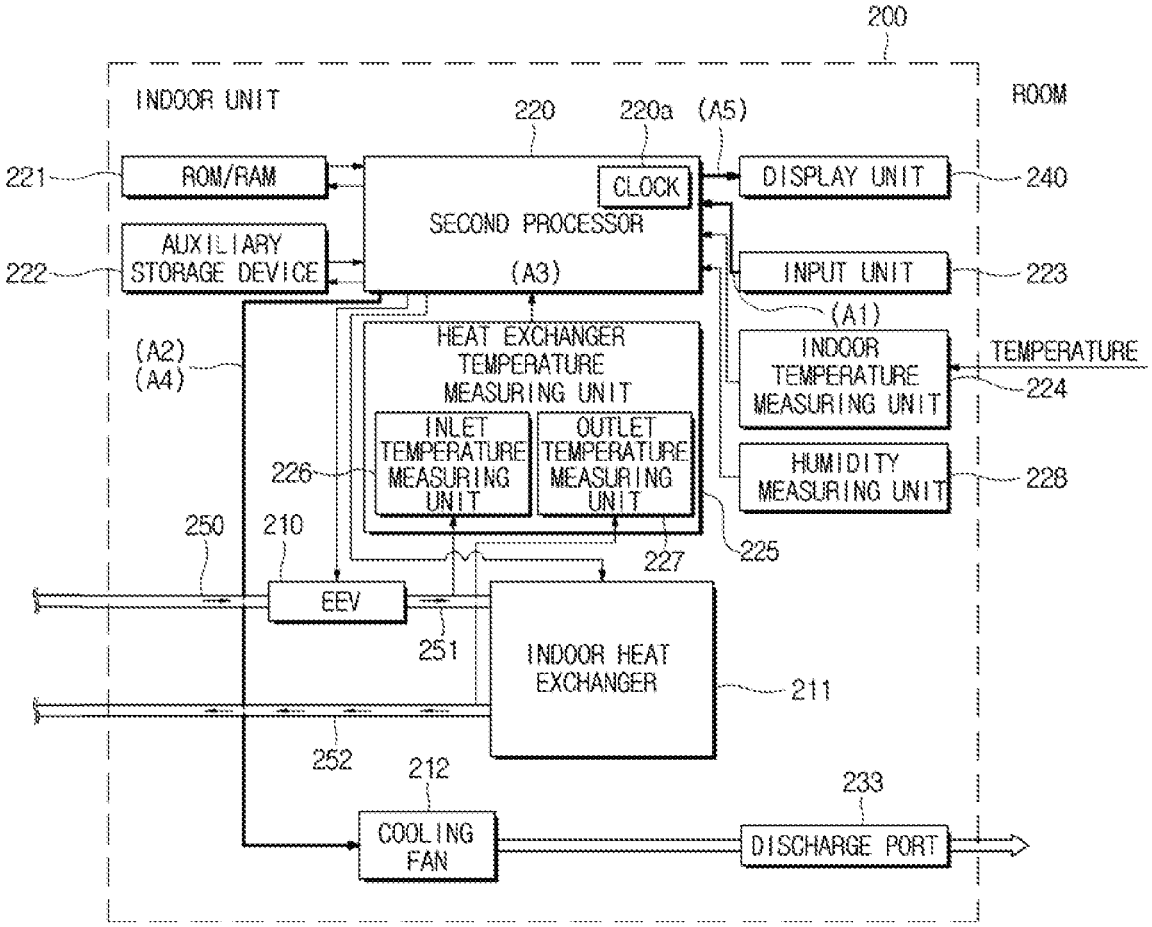
FIG. 14 illustrates the blowing operation according to various embodiments of the present disclosure.
Figure 15:
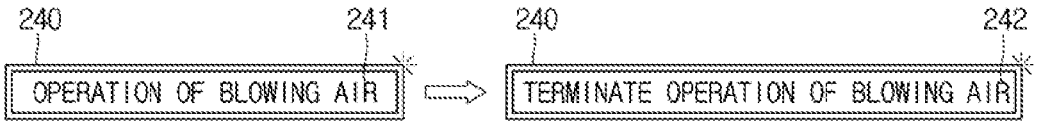
FIG. 15 illustrates a screen displayed on a display when the blowing operation is normally completed according to various embodiments of the present disclosure.
Figure 16:
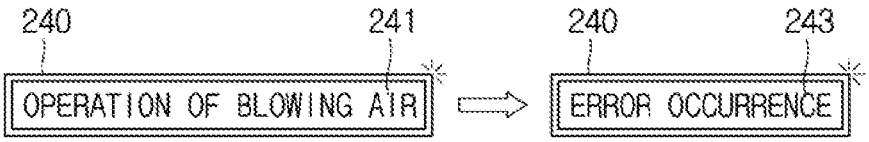
FIG. 16 illustrates a screen displayed on a display when an error occurs in the blowing operation according to various embodiments of the present disclosure.

FIG. 13 is a flowchart for explaining a blowing operation, FIG. 14 is a diagram for explaining the blowing operation, FIG. 15 is a diagram illustrating an example of a screen displayed on a display when the blowing operation is normally completed, and FIG. 16 is a diagram illustrating an example of a screen displayed on a display when an error occurs in the blowing operation.

As illustrated in FIGS. 13 and 14, when a user first inputs a trial operation start command using the input unit 223 in the operation S300 of blowing as shown by A1, the cooling fan 212 of the indoor unit 200 may be operated according to the trial operation start command input by the user, so that the indoor unit 200 may start a blowing operation in operation S310. In this case, the second processor 220 may operate the cooling fan 212 by transmitting a predetermine control signal to the cooling fan 212 as shown by A2.

When the plurality of indoor units 200 to 204 are connected to the single outdoor unit 100, the indoor unit 200 that received the trial operation start command may transmit the trial operation start command to the other indoor units 201 to 204, and the other indoor units 201 to 204 may also start the blowing operation by controlling the cooling fan.

When the cooling fan 212 is normally operated in operation S311, the blowing operation may be performed by continuously rotating the cooling fan 212 until a predetermined time has elapsed in operation S312. The second processor 220 may determine whether the cooling fan 212 is normally operated using a feedback signal transmitted from the cooling fan 212 as shown by A3, and determine whether the predetermined time has elapsed using a clock 220*a* provided in the second processor 220.

When the predetermined time has elapsed (YES of operation S312), the operation of the cooling fan 212 is terminated, and the air-blowing operation is completed in operation S313. The second processor 220 may stop the operation of the cooling fan 212 by transmitting a control signal for stopping the corresponding operation to the cooling fan 212, as shown by A4.

When the cooling fan 212 is operated for a predetermined time in this manner, the temperature sensor of the indoor temperature measuring unit 224 is saturated up to a temperature of the interior space 10, and thereby an error that occurs in a process of determining whether the cooling fan 212 is normally operated may be prevented.

When the plurality of indoor units 200 to 204 are connected to the single outdoor unit 100, the indoor unit 200 that has received the trial operation start command may complete the air blowing operation, and the other indoor units 201 to 204 may maintain the blowing operation rather than stopping the blowing operation.

When the cooling fan 212 is abnormally operated (NO of operation S311), the indoor unit 200 may determine that an error occurred, and display an error message in operation S314. Specifically, the second processor 220 may determine whether an error occurred, generate a control signal based on the determination result, and transmit the generated control signal to the display unit 240 as shown by A5, and the display unit 240 may output the error message according to the control signal.

Meanwhile, while such an operation S300 of blowing is performed, the display unit 240 may display a message 241 indicating that the operation of blowing is in progress, and according to certain embodiments, display a trial operation progress rate. The trial operation progress rate may be a means for indicating the progress of the process up to a current time out of the entire trial operation process. The trial operation progress rate may include the rate of the process processed out of the entire trial operation process. The display unit 240 may display the trial operation progress rate as being N steps (N being a natural number).

As illustrated in FIG. 15, when the operation of blowing air is terminated in operation S313, a message 242 indicating that the operation of blowing is completed may be displayed one or more times. Meanwhile, when an error occurs during the operation of blowing, the display unit 240 may display a message 243 for notifying of the occurrence of the error one or more times, as illustrated in FIG. 16. The messages 242 and 243 displayed in the display unit 240 may be stored in the main storage device 121 or auxiliary storage device 122 of the outdoor unit 100, or stored in the main storage device 221 or auxiliary storage device 222 of the indoor unit 200.

When the operation of blowing air is terminated, the operation S301 of determining the number of indoor units which will perform the trial operation and the operation S302 of determining whether the refrigerant is normally circulated may proceed.

Figure 17:
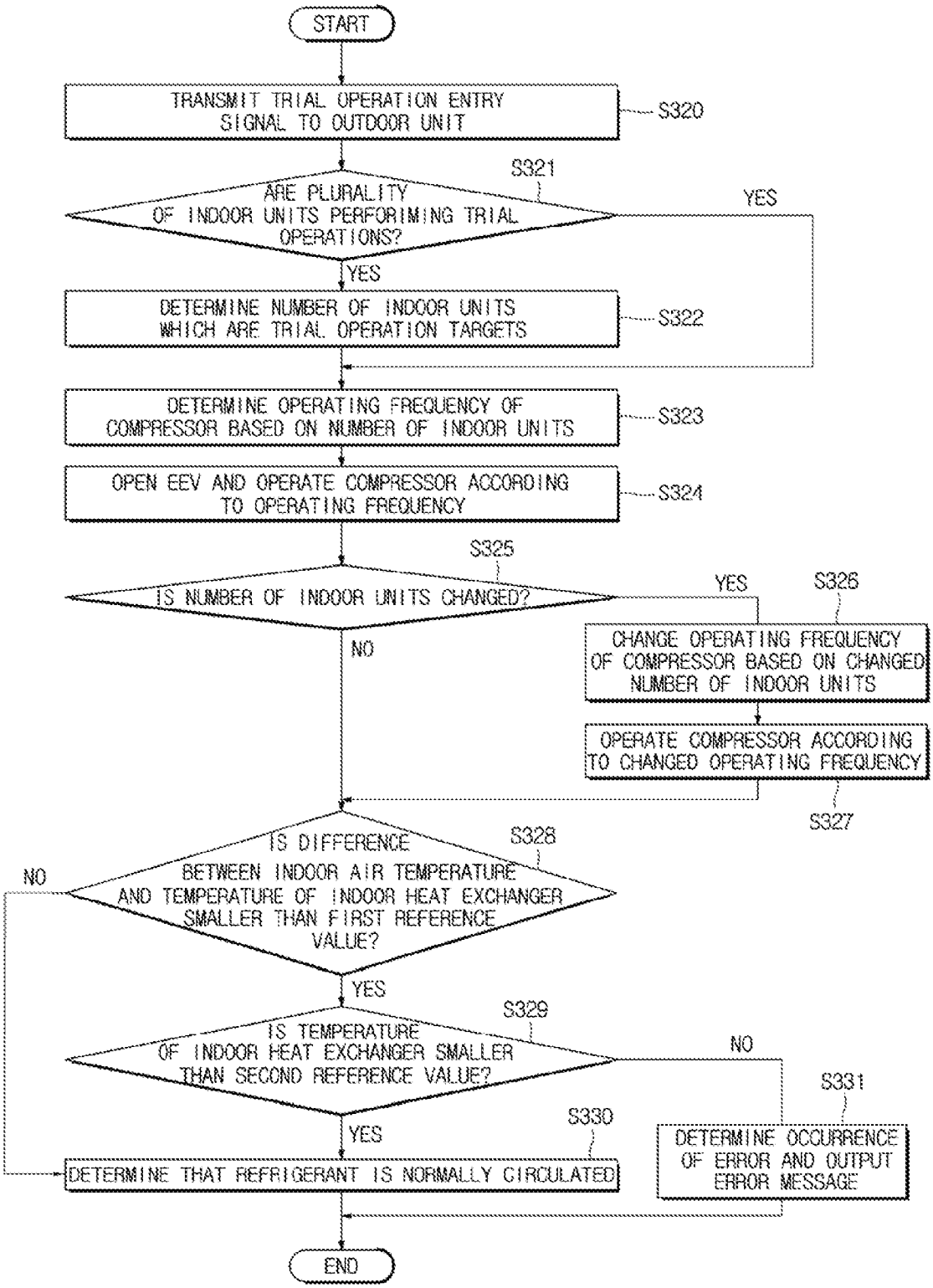
FIG. 17 illustrates a process of determining whether a refrigerant is normally circulated inside an air conditioner according to various embodiments of the present disclosure.
Figure 18:
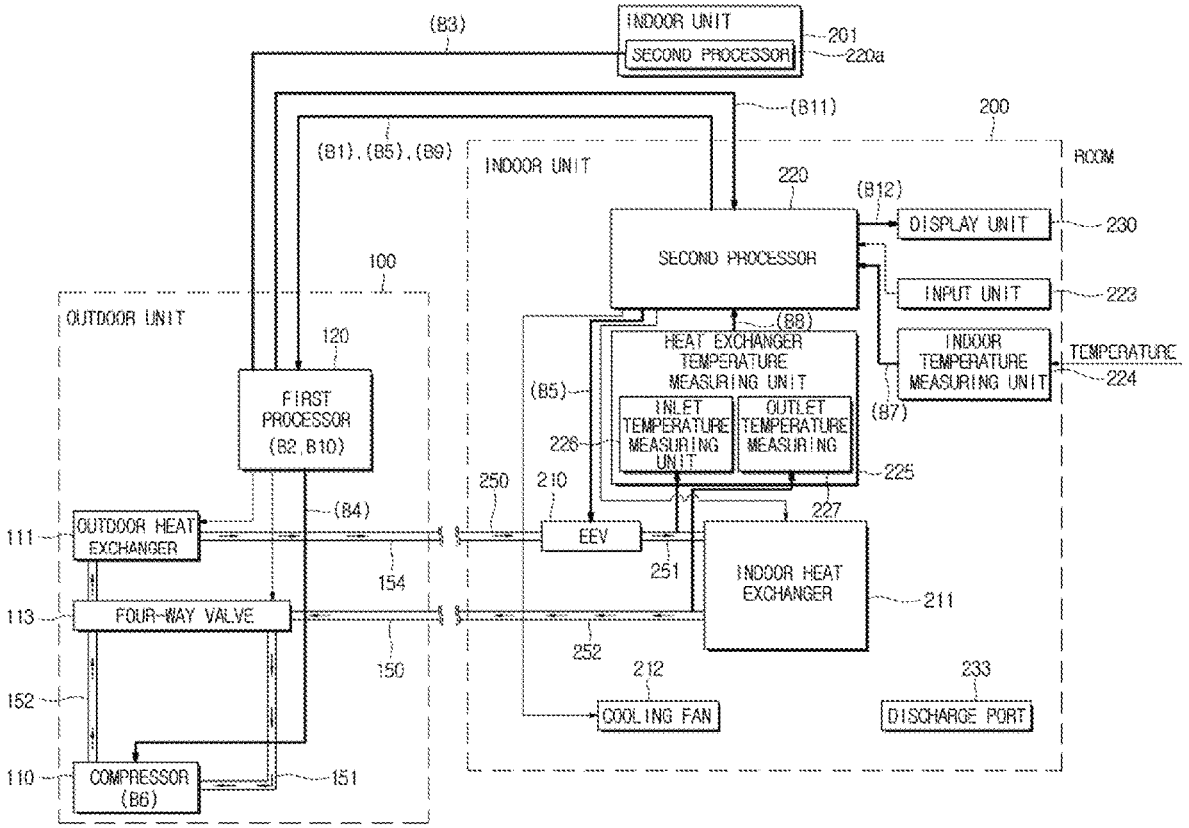
FIG. 18 illustrates the process of determining whether a refrigerant is normally circulated inside an air conditioner according to various embodiments of the present disclosure.
Figure 19:
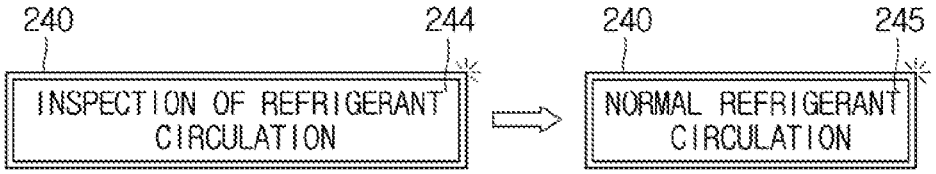
FIG. 19 illustrates an example of a screen displayed on a display when an operation of determining whether a refrigerant is normally circulated is normally completed according to various embodiments of the present disclosure.
Figure 20:
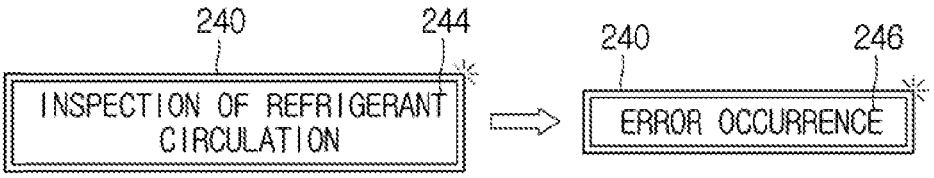
FIG. 20 illustrates an example of a screen displayed on a display when an error occurs in the operation of determining whether a refrigerant is normally circulated according to various embodiments of the present disclosure.

FIG. 17 is a flowchart for explaining a process of determining whether a refrigerant is normally circulated inside an air conditioner, FIG. 18 is a diagram explaining the process of determining whether a refrigerant is normally circulated inside an air conditioner, FIG. 19 is a diagram illustrating an example of a screen displayed on a display when an operation of determining whether a refrigerant is normally circulated is normally completed, and FIG. 20 is a diagram illustrating an example of a screen displayed on a display when an error occurs in the operation of determining whether a refrigerant is normally circulated.

As illustrated in FIGS. 17 and 18, after the operation S300 of blowing air is terminated, a trial operation entry signal may be transmitted from the indoor unit 200 to the outdoor unit 100 in operation S320. In this case, the second processor 220 may generate the trial operation entry signal to correspond to the operation S300 of blowing air, and transmit the generated trail operation entry signal to the first processor through a communication network as shown by B1.

Next, whether the plurality of indoor units are targets on which the trial operation is to be performed is determined in operation S321, and the operating frequency of the compressor 110 is determined according to the number of the indoor units in operation S323. When the plurality of indoor units 200 and 201 are the targets on which the trial operation is to be performed, a process of confirming the number of indoor units on which the trial operation is to be performed may be further performed in operation S322.

More specifically, as illustrated in FIG. 18, the first processor 120 of the outdoor unit 100 may receive the trial operation entry signal from the second processor 220 through the communication network, and determine an operating frequency of the compressor 110 according to the number of the indoor units 200. In this case, the first processor 120 may determine the number of the indoor units 200 and 201 on which the trial operation is to be performed based on a user's selection, information transmitted from the second processor 220, information transmitted from the other indoor unit 201, or the like. The first processor 120 may determine the operating frequency of the compressor 110 in proportion to the sum of required capacities of the indoor units 200 and 201. Accordingly, an operating frequency $C_f$ in a case of performing the trial operation on the single indoor unit 200 may be determined to be smaller than an operating frequency $C_{fm}$ in a case of performing the trial operation on the plurality of indoor units 200 and 201. Next, the compressor is operated according to the operating frequency, and the EEV is opened in operation S324. Specifically, the first processor 120 may transmit a control signal according to the determined operating frequencies $C_f$ and $C_{fm}$ to the compressor 110 as shown by B4, and at the same time, output a control signal for opening the EEV 210 and transmit the output control signal to the second processor 220. The second processor 220 may transmit a control signal to the EEV 210 in response to the transmitted control signal, thereby opening the EEV 210 as shown by B5. When operation of the compressor 110 is started as shown by B6 and the EEV 210 is opened, the refrigerant may flow along the compressor 110, the outdoor heat exchanger 111, the EEV 210, and the indoor heat exchanger 211 in a normal case.

Meanwhile, when the number of the indoor units on which the trial operation is to be performed is changed in operation S325, the first processor 120 may change the operating frequency of the compressor according to the changed number of indoor units in operation S326, and operate the compressor 110 according to the changed operating frequency in operation S327. In other words, when a new indoor unit is added to the already connected indoor units, or when the trial operation on the indoor unit which is an existing trial operation target is interrupted due to various reasons, the first processor 120 may change and determine the operating frequency of the compressor 110 according to the changed number of indoor units on which the trial operation is to be performed, and transmit a control signal equivalent to the determined operating frequency to the compressor 110, so that the motor of the compressor 110 may be rotated at a new operating frequency in response to the transmitted control signal.

In order to determine whether the refrigerant is normally circulated, a difference between the indoor air temperature $T_r$ and the inlet temperature $T_{in_1}$ of the indoor heat exchanger and a predefined first reference value $T_a$ are compared in operation S328. Here, the first reference value $T_a$ may include a value that is arbitrarily determined according to a designer's choice or experience.

When the difference between the indoor air temperature $T_r$ and the inlet temperature $T_{in_1}$ of the indoor heat exchanger is larger than the first reference value $T_a$, it is determined that the refrigerant is normally circulated in operation S330.

Conversely, when the difference between the indoor air temperature $T_r$ and the inlet temperature $T_{in_1}$ of the indoor heat exchanger is smaller than the first reference value $T_a$, the inlet temperature $T_{in_1}$ of the indoor heat exchanger and a predefined second reference value $T_{low}$ are compared in operation S329. Here, the second reference value $T_{low}$ may include a value that is arbitrarily determined according to a designer's choice or experience.

When the inlet temperature $T_{in_1}$ of the indoor heat exchanger is smaller than or equal to the second reference value $T_{low}$, it is determined that the refrigerant is normally circulated in operation S330, and conversely, when the inlet temperature $T_{in_1}$ of the indoor heat exchanger is larger than the second reference value $T_{low}$, it is determined that the refrigerant is abnormally circulated, and an error message is output according to the determination result one or more times in operation S331.

According to certain embodiments, operations S328 and S329 may be performed in a reverse order, or simultaneously performed. The order of operation S328 and S329 may be determined according to a designer's arbitrary choice.

When it is determined that the refrigerant is normally circulated, whether the circulation amount of the refrigerant is normal is determined in operation S303, and conversely, when it is determined that the refrigerant is abnormally circulated, the trial operation may be terminated. Specifically, the second processor 220 may receive the indoor air temperature $T_r$ measured by the indoor temperature measuring unit 224 as shown by B7, and receive the inlet temperature $T_{in_1}$ of the indoor heat exchanger from the inlet temperature measuring unit 226 of the heat exchanger temperature measuring unit 255 as shown by B8. Next, the second processor 220 may transmit the received indoor air temperature $T_r$ and the inlet temperature $T_{in_1}$ of the indoor heat exchanger to the first processor 120 as shown by B9. The indoor air temperature $T_r$ and the inlet temperature $T_{in_1}$ of the indoor heat exchanger may be transmitted to the second processor 220 in advance. For example, while the operation S300 of blowing air is in progress or immediately after the operation S300 of blowing air is terminated, the second processor 220 may receive the indoor air temperature $T_r$ and the inlet temperature $T_{in_1}$ of the indoor heat exchanger from the indoor temperature measuring unit 224 and the heat exchanger temperature measuring unit 255, respectively.

The first processor 120 may calculate the difference between the received indoor air temperature $T_r$ and the received inlet temperature $T_{in_1}$ of the indoor heat exchanger, and compare the calculated difference and the first reference value $T_a$ and also the inlet temperature $T_{in_1}$ of the indoor heat exchanger and the second reference value $T_{low}$. Next, whether the refrigerant is normally circulated is determined according to the comparison result as shown by B10.

The first processor 120 may transmit the determination result to the second processor 220, and the second processor 220 may transmit a control signal to the display unit 240 based on the determination result, so that the display unit 240 may display the determination result to a user.

While the operation S301 of determining the number of indoor units and the operation S302 of determining whether the refrigerant is normally circulated are performed, the display unit 240 may display a message 244 indicating that the operation S301 of determining the number of indoor units and the operation S302 of determining whether the refrigerant is normally circulated are in progress. As described above, the display unit 240 may display the trial operation progress rate.

When at least one of the operation S301 of determining the number of indoor units and the operation S302 of determining whether the refrigerant is normally circulated is terminated, the display unit 240 may display a message 245 indicating that the respective operations are terminated or that the refrigerant is normally circulated one or more times, as illustrated in FIG. 19. Conversely, when an error occurs in the operation S302 of determining whether the refrigerant is normally circulated, the display unit 240 may display a message 246 for notifying of the occurrence of the error one or more times, as illustrated in FIG. 20. In this case, the message 246 for notifying of the occurrence of the error may include a pipe connection error or the like. The messages 245 and 246 displayed on the display unit 240 may be stored in the main storage device 121 or the auxiliary storage device 122 of the outdoor unit 100, or may be stored in the main storage device 221 or the auxiliary storage device 222 of the indoor unit 200.

The operation S302 of determining whether the refrigerant is normally circulated is described as being performed by the first processor 120 above. According to certain embodiments, the operation S302 of determining whether the refrigerant is normally circulated may be performed by the second processor 220 of the indoor unit 200.

When it is determined that the refrigerant is normally circulated, whether the circulation amount of the refrigerant is normal is determined in operation S303. The determination of whether the circulation amount of the refrigerant is normal may be performed when a predetermined time elapses after whether the refrigerant is normally circulated is determined. For example, when 5 to 6 minutes pass after the determination of whether the refrigerant is normally circulated, the determination of whether the circulation amount of the refrigerant is normal is started.

Figure 21:
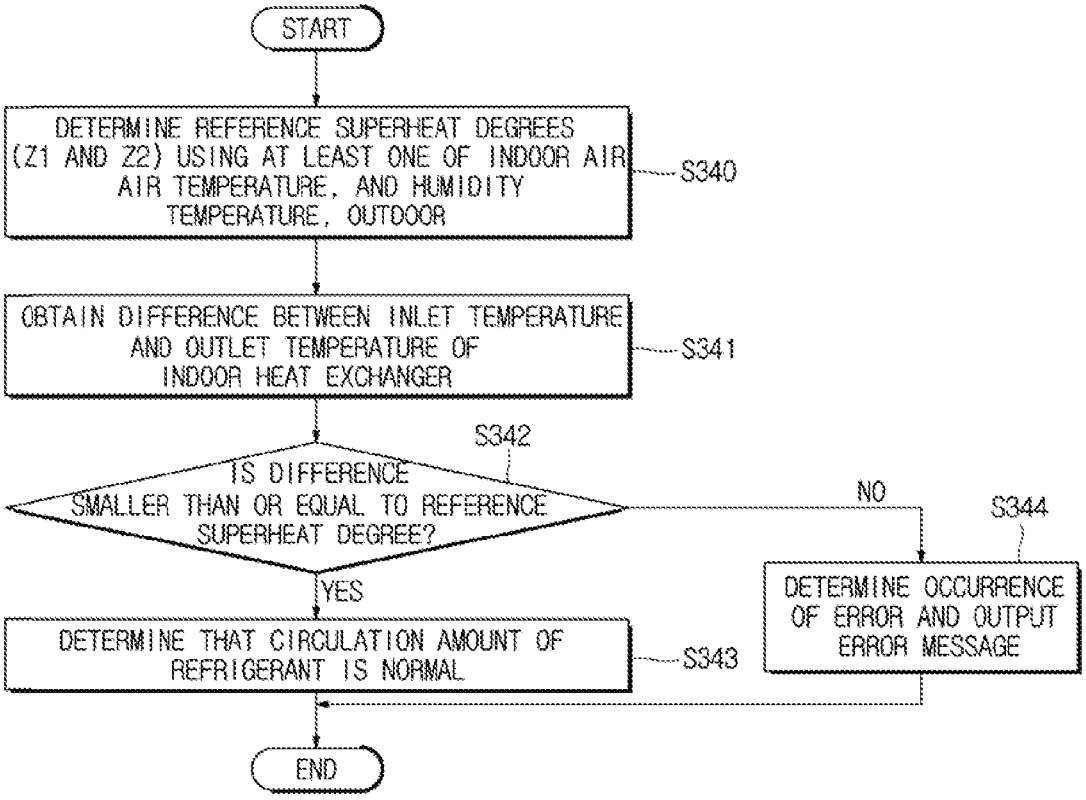
FIG. 21 illustrates a process of determining whether an amount of a refrigerant circulated inside an air conditioner is normal according to various embodiments of the present disclosure.
Figure 22:
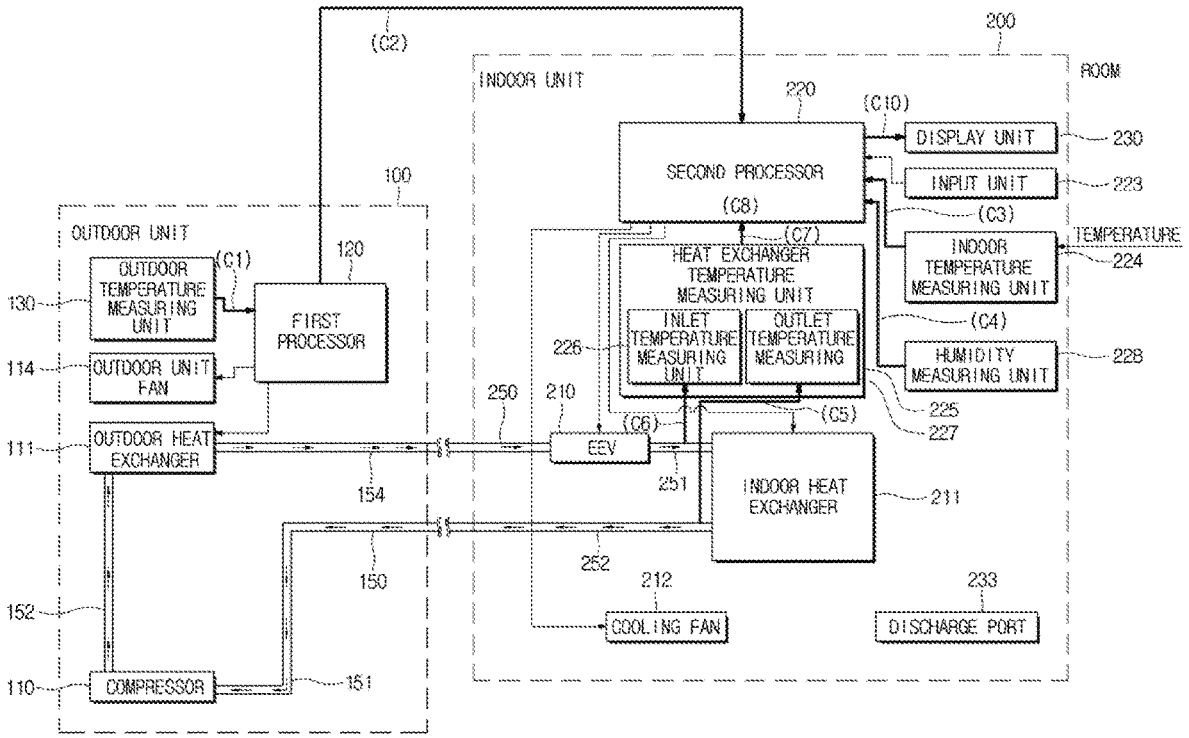
FIG. 22 illustrates the process of determining whether a circulation amount of a refrigerant circulated inside an air conditioner is normal according to various embodiments of the present disclosure.
Figure 23:
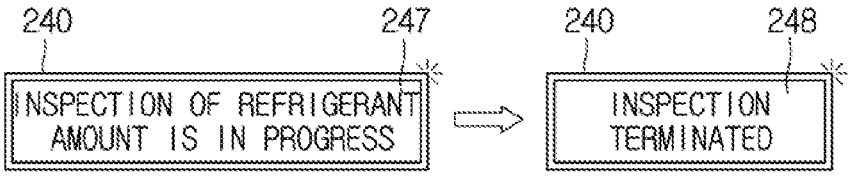
FIG. 23 illustrates an example of a screen displayed on a display when an operation of determining whether a circulation amount of a refrigerant is normal is normally completed according to various embodiments of the present disclosure.
Figure 24:
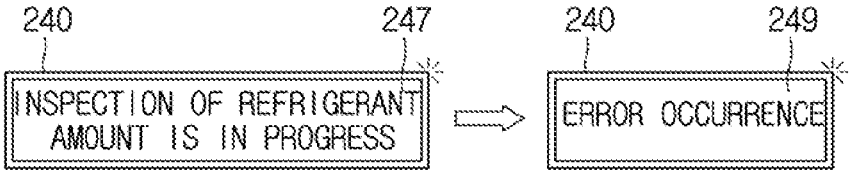
FIG. 24 illustrates an example of a screen displayed on a display when an error occurs in the operation of determining whether a circulation amount of a refrigerant is normal according to various embodiments of the present disclosure.

FIG. 21 is a flowchart for explaining a process of determining whether an amount of a refrigerant circulated inside an air conditioner is normal, FIG. 22 is a block diagram for explaining the process of determining whether a circulation amount of a refrigerant circulated inside an air conditioner is normal, FIG. 23 is a diagram illustrating an example of a screen displayed on a display when an operation of determining whether a circulation amount of a refrigerant is normal is normally completed, and FIG. 24 is a diagram illustrating an example of a screen displayed on a display when an error occurs in the operation of determining whether a circulation amount of a refrigerant is normal.

In order to determine whether the circulation amount of the refrigerant is normal, the reference superheat degree $Z_1$ may be determined using the indoor air temperature $T_r$ and the outdoor air temperature $T_o$, or the reference superheat degree $Z_2$ may be determined using the indoor air temperature $T_r$, the outdoor air temperature $T_o$, and the indoor humidity $H_r$ in operation S340.

Next, a difference between the inlet temperature $T_{in_2}$ of the indoor heat exchanger and the outlet temperature $T_{out}$ of the indoor heat exchanger, that is, an actually measured superheat X is obtained in operation S341.

Next, the difference between the inlet temperature $T_{in_1}$ of the indoor heat exchanger and the outlet temperature $T_{out}$ of the indoor heat exchanger is compared with the determined reference superheat degrees $Z_1$ and $Z_2$ in operation S342, and whether the circulation amount of the refrigerant is normal is determined based on the comparison result in operation S343.

When the difference between the inlet temperature $T_{in_2}$ of the indoor heat exchanger and the outlet temperature $T_{out}$ of the indoor heat exchanger is smaller than or equal to the determined reference superheat degrees $Z_1$ and $Z_2$ (YES of operation S342), it is determined that the circulation amount of the refrigerant is normal in operation S343. Conversely, when the difference between the inlet temperature $T_{in_2}$ of the indoor heat exchanger and the outlet temperature $T_{out}$ of the indoor heat exchanger is larger than the determined reference superheat degrees $Z_1$ and $Z_2$ (NO of operation 342), it is determined that the circulation amount of the refrigerant is abnormal in operation S344. In other words, it is determined that an error occurs. In this case, an error message may be output.

More specifically, when it is determined that the refrigerant is normally circulated, the first processor 120 may receive data of the outdoor air temperature $T_o$ from the outdoor temperature measuring unit 130 as shown by C1, and transmit the received data of the outdoor air temperature $T_o$ to the second processor 200 as shown by C2.

The second processor 220 may receive data of the indoor air temperature $T_r$ from the indoor temperature measuring unit 224 as shown by C3, and receive data of the indoor humidity $H_r$ from the humidity measuring unit 228 as shown by C4. According to certain embodiments, the second processor 220 may not receive the data of the indoor humidity $H_r$. In addition, the outlet temperature measuring unit 227 may measure the outlet temperature $T_{out}$ of the indoor heat exchanger 221 as shown by C5, the inlet temperature measuring unit 226 may measure the inlet temperature $T_{in_1}$ of the indoor heat exchanger as shown by C6, and the second processor 220 may receive data of the measured outlet temperature $T_{out}$ of the indoor heat exchanger and data of the inlet temperature $T_{in_2}$ of the indoor heat exchanger as shown by C7.

Here, the received inlet temperature $T_{in_2}$ of the indoor heat exchanger may be the same as or different from the inlet temperature $T_{in_1}$ of the indoor heat exchanger used to determine whether the refrigerant is normally circulated. When the inlet $T_{in_2}$ of the indoor heat exchanger is different from the inlet temperature $T_{in_1}$ of the indoor heat exchanger, the inlet temperature $T_{in_2}$ of the indoor heat exchanger may be the inlet temperature of the indoor heat exchanger obtained later than the inlet temperature $T_{in_1}$ of the indoor heat exchanger used to determine whether the refrigerant is normally circulated. For example, the inlet temperature $T_{in_2}$ of the indoor heat exchanger may be the inlet temperature of the indoor heat exchanger obtained after the refrigerant is normally circulated for a predetermined time.

According to certain embodiments, the second processor 220 may calculate the reference superheat degree $Z_1$ using the received indoor air temperature $T_r$ and the outdoor air temperature $T_o$, calculate a difference between the outlet temperature $T_{out}$ of the indoor heat exchanger 221 and the inlet temperature $T_{in_2}$ of the indoor heat exchanger, and then compare the reference superheat degree $Z_1$ and the difference between the outlet temperature $T_{out}$ of the indoor heat exchanger 221 and the inlet temperature $T_{in_2}$ of the indoor heat exchanger, thereby determining whether the circulation amount of the refrigerant is normal as shown by C8.

According to another embodiment, the second processor 220 may calculate the reference superheat degree $Z_2$ using the received indoor air temperature $T_r$, the received outdoor air temperature $T_o$, and the received indoor humidity $H_r$, compare a difference between the outlet temperature $T_{out}$ of the indoor heat exchanger 221 and the inlet temperature $T_{in_2}$ of the indoor heat exchanger, and then compare the reference superheat degree $Z_2$ and the difference between the outlet temperature $T_{out}$ of the indoor heat exchanger 221 and the inlet temperature $T_{in_2}$ of the indoor heat exchanger, thereby determining whether the circulation amount of the refrigerant is normal as shown by C8.

When the difference between the outlet temperature $T_{out}$ of the indoor heat exchanger 221 and the inlet temperature $T_{in_2}$ of the indoor heat exchanger is smaller than or equal to the reference superheat degrees $Z_1$ and $Z_2$, the second processor 200 may determine that the circulation amount of the refrigerant is normal, and conversely, when the difference between the outlet temperature $T_{out}$ of the indoor heat exchanger 221 and the inlet temperature $T_{in_2}$ of the indoor heat exchanger is larger than the reference superheat degrees $Z_1$ and $Z_2$, the second processor 200 may determine that the circulation amount of the refrigerant is abnormal. When the circulation amount of the refrigerant is abnormal, the second processor 220 may transmit a control signal to the display unit 240 so that an error message may be displayed to a user as shown by C10.

While the operation S303 of determining whether the circulation amount of the refrigerant is normal is performed, the display unit 240 may display a message 247 indicating that the operation S303 of determining whether the circulation amount of the refrigerant is normal is in progress, as illustrated in FIGS. 23 and 24. Similarly, the display unit 240 may display the trial operation progress rate. The display unit 240 may display messages 248 and 249 according to the control signal transmitted from the first processor 120 of the outdoor unit 100 or the control signal transmitted from the second processor 220 of the indoor unit 200. The messages 248 and 249 displayed on the display unit 240 may be stored in the main storage device 121 or the auxiliary storage device 122 of the outdoor unit 100 or stored in the main storage device 221 or the auxiliary storage device 222 of the indoor unit 200.

When the operation S303 of determining whether the circulation amount of the refrigerant is normal is terminated and the circulation amount of the refrigerant is normal, the display unit 240 may display the message 248 indicating that the respective operations are terminated or that the circulation amount of the refrigerant is normal one or more times, as illustrated in FIG. 23. In this case, a message indicating that the air conditioner 1 is normally operated may be displayed instead of the message 248 indicating that the circulation amount of the refrigerant is normal.

When an error occurs due to the abnormality of the circulation amount of the refrigerant in the operation S303 of determining whether the circulation amount of the refrigerant is normal, the display unit 240 may display the message for notifying of the occurrence of the error one or more times, as illustrated in FIG. 24. Such a control of the display unit 240 may be performed by the second processor 220.

Certain embodiments in which the operation S303 of determining whether the circulation amount of the refrigerant is normal is performed by the second processor 220 has been described above, but the operation of determining whether the circulation amount of the refrigerant is normal may also be performed by the first processor 120 in the same manner.

When the above-described operations S300 to S303 are all terminated, the operations of all of the indoor units 200 may be terminated.

When the plurality of indoor units 200 to 203 are connected to the single outdoor unit 100 as illustrated in FIG. 9, the above-described operation S302 of determining whether the refrigerant is normally circulated and the operation S303 of determining whether the circulation amount of the refrigerant is normal may first be performed in any one indoor unit, for example, the first indoor unit 200, of the plurality of indoor units 200 to 203. When the operation S302 of determining whether the refrigerant is normally circulated and the operation S303 of determining whether the circulation amount of the refrigerant is normal are performed in the first indoor unit 200, the other indoor units 201 to 203 may maintain the above-described operation S300 of blowing air.

When the operation S302 of determining whether the refrigerant is normally circulated and the operation S303 of determining whether the circulation amount of the refrigerant is normal are terminated in the first indoor unit 200, the operation S302 of determining whether the refrigerant is normally circulated may be performed in any one indoor unit of the other indoor units 201 to 203, for example, the second indoor unit 201. In this case, the above-described operation S303 of determining whether the circulation amount of the refrigerant is normal may be omitted. In other words, after the operation S302 of determining whether the refrigerant is normally circulated is performed using the second indoor unit 201, the trial operation is terminated, and whether the circulation amount of the refrigerant is normal may not be determined. This is because of the fact that the circulation amount of the refrigerant is normal is determined by the first indoor unit 200. Meanwhile, when the operation S302 of determining whether the refrigerant is normally circulated is performed in the second indoor unit 201, the other indoor units 202 and 203 may stand by while maintaining the operation S300 of blowing air. When the operation S302 of determining whether the refrigerant is normally circulated is terminated in the second indoor unit 201, the other indoor units 202 and 203 may sequentially determine whether the refrigerant is normally circulated in operation S302.

When the trial operations of the indoor units 200 to 204 are all terminated, a messages associated with the trial operation termination and the normal operation or a message associated with the occurrence of the error may be displayed one or more times for each of the display units 240 of the indoor units 200 to 204.

In addition, the messages associated with the trial operation termination and the normal operation or the message associated with the occurrence of the error of each of the indoor units 200 to 204 may be displayed one or more times in the display unit 240 of a specific indoor unit, for example, the first indoor unit 200. In this case, the display unit 240 of the first indoor unit 200 may further display an address allocated for each of the indoor units 200 to 204, and a user may determine whether the trial operation of any indoor unit 200 to 204 is normally terminated or whether an error occurs by using the allocated address.

According to the above-described air conditioner and the method for controlling the air conditioner, a user, a manufacturer, or an installer of the air conditioner may simply, easily, and rapidly determine whether the air conditioner is normally operated.

According to the above-described air conditioner and the method for controlling the air conditioner, a user, a manufacturer, or an installer of the air conditioner may simply and accurately determine at least one of whether an internal pipe is appropriately connected to the air conditioner, whether a refrigerant flows inside the air conditioner, and whether an amount of the refrigerant flowing inside the air conditioner is a proper amount.

According to the above-described air conditioner and the method for controlling the air conditioner, when a manufacture of the air conditioner inspects the air conditioner in various environmental conditions by performing a trial operation of the air conditioner, since whether the manufactured air conditioner is normally operated may be appropriately determined by performing the trial operation only in selected partial environmental conditions without performing the trial operation of the air conditioner in all environmental conditions, the convenience of the trial operation of the air conditioner may be improved.

In addition, since quality inspection of the completed air conditioner may be more easily and simply performed within a short time according to the improvement in the convenience of the trial operation of the air conditioned, the inspection time and inspection costs of the air conditioner may be reduced.

In addition, according to the above-described air conditioner and the method for controlling the air conditioner, since a blocked state of the refrigerant may be detected by locking valves as well as checking pipes and malfunction may be prevented, it is possible to prevent a risk that may occur due to damaged parts or the like.

In addition, according to the above-described air conditioner and the method for controlling the air conditioner, since it is possible to accurately determine and confirm a defect that may occur in the installation process while performing the trial operation, an installer of the air conditioner may perform the installation and take follow-up measures using objective and precise criteria, and thereby the competitiveness of the product in the installation process may be improved and customer confidence and satisfaction may be further enhanced.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An air conditioner comprising:

an indoor thermometer configured to measure an indoor air temperature;

an outdoor thermometer configured to measure an outdoor air temperature;

an inlet heat exchanger thermometer configured to measure an inlet temperature of one or more indoor heat exchangers and an outlet heat exchanger thermometer configured to measure an outlet temperature of the one or more indoor heat exchangers;

a cooling fan configured to blow cold air generated in the one or more indoor heat exchangers;

a compressor connected to the one or more indoor heat exchangers;

a processor configured to:

receive a trial operation start command and start a trial operation of the air conditioner, operate the cooling fan first before a first set of one or more indoor heat exchangers start to operate, the first set of one or more indoor heat exchangers associated with indoor units that are trial operation targets start to operate, determine whether the cooling fan is operating normally using a feedback signal transmitted from the cooling fan, determine a number of the indoor units that are the trial operation targets, operate the compressor, determine a reference superheat degree using the indoor air temperature, the outdoor air temperature, obtain a difference between the inlet temperature and the outlet temperature of the first set of one or more indoor heat exchangers, compare the difference between the inlet temperature and the outlet temperature of the first set of one or more indoor heat exchangers and the reference superheat degree, and determine, based on the difference between the inlet temperature and the outlet temperature of the first set of one or more indoor heat exchangers and the reference superheat degree, whether a circulation amount of refrigerant for the indoor units that are the trial operation targets is between reference values defining a normal range; and a display configured to display whether the cooling fan is operating normally and whether the circulation amount of the refrigerant is normal, related to the indoor units that are the trial operation targets.

2. The air conditioner according to claim 1, wherein the processor is further configured to determine the reference superheat degree based on a correlation obtained in advance among the indoor air temperature, the outdoor air temperature, and a measured superheat degree.

3. The air conditioner according to claim 2, wherein the processor is further configured to determine the reference superheat degree using a linear relational expression among the indoor air temperature, the outdoor air temperature, and the measured superheat degree that are obtained in advance using regression analysis.

4. The air conditioner according to claim 1, wherein the processor is further configured to:

determine that the circulation amount of the refrigerant of the air conditioner is normal when the difference between the inlet temperature and the outlet temperature of the first set of one or more indoor heat exchangers is smaller than or equal to the reference superheat degree, and determine that the circulation amount of the refrigerant for the indoor units that are the trial operation targets is abnormal when the difference between the inlet temperature and the outlet temperature of the first set of one or more indoor heat exchangers associated with the indoor units that are the trial operation targets is larger than the reference superheat degree.

5. The air conditioner according to claim 1, wherein the processor is further configured to:

obtain temperature values from the inlet heat exchanger thermometer and from the indoor thermometer;

determine a difference between the inlet temperature of the first set of one or more indoor heat exchangers and the indoor air temperature;

compare the difference between the inlet temperature of the first set of one or more indoor heat exchangers and the indoor air temperature and a first reference value;

compare the inlet temperature of the first set of one or more indoor heat exchangers and a second reference value; and determine whether the refrigerant for the indoor units that are the trial operation targets is normally circulated.

6. The air conditioner according to claim 5, wherein the processor is further configured to determine that the refrigerant is normally circulated when the difference between the inlet temperature of the first set of one or more indoor heat exchangers associated with the indoor units that are the trial operation targets and the indoor air temperature is larger than the first reference value or when the inlet temperature of the first set of one or more indoor heat exchangers is smaller than the second reference value.

7. The air conditioner according to claim 1, wherein the processor is configured to determine whether the first set of one or more indoor heat exchangers comprises a plurality of indoor heat exchangers.

8. A method for controlling an air conditioner, the air condition comprising a plurality of indoor units, each indoor unit of the plurality of indoor units comprising an indoor heat exchanger and a cooling fan that blows cold air generated in the indoor heat exchanger, and wherein the air conditioner further comprises a compressor connected to the indoor heat exchanger of each indoor unit of the plurality of indoor units, the method for controlling the air conditioner comprising:

receiving, by a processor, a trial operation start command and starting a trial operation of a number of indoor units that are trial operation targets;

operating the cooling fan before a first set of indoor heat exchangers start to operate, the first set of indoor heat exchangers associated with the number of indoor units that are the trial operation targets;

determining, by the processor, whether the cooling fan is operating normally using a feedback signal transmitted from the cooling fan;

determining, by the processor, a number of indoor units that are the trial operation targets;

operating the compressor;

obtaining, by the processor, a difference between an inlet temperature of the indoor heat exchanger as measured at an inlet heat exchanger thermometer and an outlet temperature of the first set of indoor heat exchangers as measured at an outlet heat exchanger thermometer;

obtaining, by one or more thermometers, an indoor air temperature and an outdoor air temperature;

comparing, by the processor, a reference superheat degree determined using the indoor air temperature and the outdoor air temperature and the difference between the inlet temperature and the outlet temperature of the first set of indoor heat exchangers;

determining, by the processor as a function of comparing the reference superheat degree and the difference between the inlet temperature and the outlet temperature of the first set of indoor heat exchangers, whether a circulation amount of refrigerant for the indoor units that are the trial operation targets is between reference values defining a normal range; and displaying, by a display, whether the cooling fan is operating normally and whether the circulation amount of the refrigerant is normal, related to the indoor units that are the trial operation targets.

9. The method for controlling the air conditioner according to claim 8, wherein the reference superheat degree is determined based on a correlation among the indoor air temperature, the outdoor air temperature, and a measured superheat degree.

10. The method for controlling the air conditioner according to claim 9, wherein the reference superheat degree is determined using a linear relational expression among the indoor air temperature, the outdoor air temperature, and the measured superheat degree that are obtained in advance using regression analysis.

11. The method for controlling the air conditioner according to claim 8, wherein the determining of whether the circulation amount of the refrigerant of the air conditioner is between the reference values defining the normal range includes:

determining that the circulation amount of the refrigerant for the indoor units that are the trial operation targets is normal when the difference between the inlet temperature and the outlet temperature of the first set of indoor heat exchangers associated with the indoor units that are the trial operation targets is smaller than or equal to the reference superheat degree, and determining that the circulation amount of the refrigerant of the air conditioner is abnormal when the difference between the inlet temperature and the outlet temperature of the indoor heat exchanger associated with the indoor units that are the trial operation targets is larger than the reference superheat degree.

* * * * *